US009091977B2

(12) United States Patent
Saito et al.

(10) Patent No.: US 9,091,977 B2
(45) Date of Patent: Jul. 28, 2015

(54) HEATER WITH INSULATED SUBSTRATE HAVING THROUGH HOLES AND IMAGE HEATING APPARATUS INCLUDING THE HEATER

(71) Applicant: CANON KABUSHIKI KAISHA, Tokyo (JP)

(72) Inventors: Shuji Saito, Suntou-gun (JP); Hiroyuki Sakakibara, Yokohama (JP); Yusuke Nakashima, Suntou-gun (JP); Atsuhiko Yamaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/659,266

(22) Filed: Oct. 24, 2012

(65) Prior Publication Data

US 2013/0108306 A1 May 2, 2013

(30) Foreign Application Priority Data

Nov. 1, 2011 (JP) ..... 2011-240227
May 10, 2012 (JP) ..... 2012-108476

(51) Int. Cl.
*G03G 15/20* (2006.01)
*H05B 3/46* (2006.01)

(52) U.S. Cl.
CPC ..... *G03G 15/2053* (2013.01); *G03G 15/2057* (2013.01); *H05B 3/46* (2013.01); *G03G 15/2021* (2013.01); *G03G 15/2082* (2013.01)

(58) Field of Classification Search
CPC ..... G03G 15/2021; G03G 15/2042; G03G 15/2082; G03G 15/2053
USPC ..... 399/333–334; 219/543
See application file for complete search history.

(56) References Cited

U.S. PATENT DOCUMENTS 4,792,646 A * 12/1988 Enomoto ..... 174/266
5,306,898 A * 4/1994 Yukawa et al. ..... 219/543
5,343,021 A 8/1994 Sato et al.

(Continued)

FOREIGN PATENT DOCUMENTS

JP 04-185455 A 7/1992
JP 5-266963 A 10/1993

(Continued)

OTHER PUBLICATIONS

English Translation of Kawazu, Takao. "Heat Source, Heating Device and Imaging Device". Pub. Oct. 11, 2002 in the Japanese Patent Office as JP2002-299014.*

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

The image heating apparatus includes an endless belt, a connector and a heater including an insulated substrate, a heat generating resistor, an electrode brought into contact with a contact of the connector; and a conductor provided on a surface of the insulated substrate opposite to a surface on which the electrode wherein the insulated substrate includes multiple through holes electrically connecting the electrode and the conductor to each other, in an area in which the electrode is provided, wherein the distances between a position on the electrode brought into contact with the contact and the multiple through holes are substantially equal to each other, so that burning of the through hole and conduction failure caused by the burning can be prevented.

16 Claims, 18 Drawing Sheets

(56) References Cited

U.S. PATENT DOCUMENTS

| | | | | |
|---|---|---|---|---|
| 6,754,064 | B2 * | 6/2004 | Azuma et al. | 361/302 |
| 6,828,513 | B2 * | 12/2004 | Kistner | 174/261 |
| 7,321,746 | B2 | 1/2008 | Sakakibara et al. | |
| 7,974,563 | B2 | 7/2011 | Sakai et al. | |
| 8,005,413 | B2 | 8/2011 | Sakakibara et al. | |
| 8,224,223 | B2 | 7/2012 | Sakakibara et al. | |
| 8,369,763 | B2 | 2/2013 | Sakakibara et al. | |
| 2004/0223310 | A1 * | 11/2004 | Toyomura | 361/777 |
| 2011/0091252 | A1 | 4/2011 | Sekihara et al. | |
| 2011/0217092 | A1 | 9/2011 | Sekihara et al. | |
| 2011/0286775 | A1 * | 11/2011 | Ishihara et al. | 399/329 |
| 2012/0014726 | A1 | 1/2012 | Sekihara et al. | |
| 2012/0273478 | A1 | 11/2012 | Saito | |
| 2012/0308280 | A1 | 12/2012 | Tsuruya et al. | |

FOREIGN PATENT DOCUMENTS

| | | | |
|---|---|---|---|
| JP | 2000-030844 | A | 1/2000 |
| JP | 2002-299014 | A | 10/2002 |

* cited by examiner

HEATER WITH INSULATED SUBSTRATE HAVING THROUGH HOLES AND IMAGE HEATING APPARATUS INCLUDING THE HEATER

BACKGROUND OF THE INVENTION

1. Field of the Invention

The present invention relates to a heater suitable to be used as a ceramic heater used in a fixing apparatus mounted to an image forming apparatus such as an electrophotographic copying machine and an electrophotographic printer, and to an image heating apparatus having the heater mounted thereon, such as a fixing apparatus.

2. Description of the Related Art

Image forming apparatus employing an electrophotographic system have been developed for higher speed, higher function, and colorization, and various types of copying machines and printers have been placed on the market.

On the copying machines and printers employing the electrophotographic system, there is mounted a fixing apparatus for heating an unfixed toner image formed on a recording material to fix the toner image onto the recording material. As one heating system for the fixing apparatus, there is a film heating system.

The film heating system is a system in which a ceramic heater is provided on an inside surface of the cylindrical shape of a fixing film and a pressure roller is provided at a position opposed to the ceramic heater across the cylindrical film to bring the fixing film into contact with the recording material by pressing the pressure roller toward the ceramic heater so that heat of a ceramic heater is applied into the recording material. The cylindrical film (fixing film) is made of a heat resistant resin or metal based material.

The ceramic heater used in the fixing apparatus employing the film heating system often includes, on a heater substrate made of ceramics, a heat generating resistor formed of an electrical resistor, a power feeding electrode made of silver and the like, and an insulating layer made of glass for protection of the heat generating resistor. Further, in most cases, power is fed to the ceramic heater by a method of bringing a connector including a power feeding contact into press contact with the electrode on the heater substrate, thereby forming an electrically conductive path.

In the ceramic heater, in most cases, the heat generating resistor and the electrode are formed on the same surface of the heater substrate. However, in some cases, in order to reduce cost by using general connectors or reducing the substrate width, the heat generating resistor and the electrode are formed on opposite surfaces of the heater substrate, respectively. In the ceramic heater with such a configuration, a through hole is formed in the heater substrate so that a conductive path is formed between the heat generating resistor and the electrode.

Japanese Patent Application Laid-Open No. 2002-299014 discloses a ceramic heater in which heat generating resistors having different heat generation areas are formed on both surfaces of the heater substrate, and a through hole is used to feed power from one of the surfaces. It is known that, when small-sized recording materials are successively printed by a printer mounting a fixing apparatus employing the film heating system at the same printing interval as that for large-sized recording materials, a temperature of an area of the ceramic heater in which the recording material does not pass (non-sheet passing area) excessively rises (non-paper passing portion temperature rise).

In the configuration of the ceramic heater disclosed in Japanese Patent Application Laid-Open No. 2002-299014, in order to address the problem called the non-paper passing portion temperature rise, heat generating resistors having different lengths are provided on both surfaces of the heater substrate, and the heat generating resistors are selectively used depending on the paper size. Further, when two heat generating resistors are formed on the same surface of the heater substrate, it is necessary to increase the width of the heater substrate by the width of the respective heat generating resistors and a distance for ensuring insulation between the two heat generating resistors. However, when the heat generating resistors are divided onto front and back surfaces of the substrate, increase of the substrate width can be prevented.

By the way, in the ceramic heater in which power is fed to the heat generating resistors on both surfaces of the heater substrate via the through hole as described above, as compared to a general integrated circuit device, it is required to cause a larger amount of current to flow. In some cases, the through hole abnormally generates heat to be burned, which may cause conduction failure.

Japanese Patent Application Laid-Open No. H04-185455 discloses a configuration in which, when power is fed to the heat generating resistors on both surfaces of the heater substrate via the through hole, multiple through holes are used to prevent conduction failure caused by the burning of the through hole.

As described above, in the ceramic heater in which power is fed to the heat generating resistors via the through hole, it is demanded to prevent burning of the through hole and conduction failure caused by the burning. Even in the case of feeding power via multiple through holes, a further improvement is demanded.

SUMMARY OF THE INVENTION

A purpose of the present invention is to provide a heater capable of preventing burning of a through hole and conduction failure caused by the burning in a heating member in which power is fed to heat generating resistors via multiple through holes formed in a substrate, and to provide an image heating apparatus including the heater.

Another purpose of the present invention to provide an image heating apparatus, including an endless belt, a heater provided in contact with an inside surface of the endless belt, and a connector for supplying power to the heater, in which the heater includes an insulated substrate, a heat generating resistor provided on the insulated substrate, an electrode electrically connected to the heat generating resistor and brought into contact with a contact of the connector, and a conductor electrically connected to the heat generating resistor and provided on a surface of the insulated substrate opposite to a surface on which the electrode is provided, in which the insulated substrate includes multiple through holes in an area in which the electrode is provided, the multiple through holes electrically connecting the electrode and the conductor to each other, and in which distances between a position on the electrode brought into contact with the contact and the multiple through holes are substantially equal to each other.

Another purpose of the present invention to provide a heater for an image heating apparatus, the heater including an insulated substrate, a heat generating resistor provided on the insulated substrate, an electrode electrically connected to the heat generating resistor and brought into contact with a contact of a connector, the connector being provided to the image heating apparatus for power supply, and a conductor electrically connected to the heat generating resistor and provided on a surface of the insulated substrate opposite to a surface on which the electrode is provided, in which the insulated substrate includes multiple through holes in an area in which the electrode is provided, the multiple through holes electrically connecting the electrode and the conductor to each other, and in which distances between a position on the electrode brought into contact with the contact and the multiple through holes are substantially equal to each other.

A further purpose of the present invention is to provide an image heating apparatus, including an endless belt, a heater provided in contact with an inside surface of the endless belt, and a connector for supplying power to the heater, in which the heater includes an insulated substrate, a heat generating resistor provided on the insulated substrate, an electrode electrically connected to the heat generating resistor and brought into contact with a contact of the connector, and a conductor electrically connected to the heat generating resistor and provided on a surface of the insulated substrate opposite to a surface on which the electrode is provided, in which the insulated substrate includes at least three through holes in an area in which the electrode is provided, the at least three through holes electrically connecting the electrode and the conductor to each other, and in which a position on the electrode brought into contact with the contact is surrounded by the at least three through holes.

A still further purpose of the present invention to provide a heater to be used in an image heating apparatus, the heater including an insulated substrate, a heat generating resistor provided on the insulated substrate, an electrode electrically connected to the heat generating resistor and brought into contact with a contact of a connector, the connector being provided to the image heating apparatus for power supply, and a conductor electrically connected to the heat generating resistor and provided on a surface of the insulated substrate opposite to a surface on which the electrode is provided, in which the insulated substrate includes at least three through holes in an area in which the electrode is provided, the at least three through holes electrically connecting the electrode and the conductor to each other, and in which a position on the electrode brought into contact with the contact is surrounded by the at least three through holes.

Further features of the present invention will become apparent from the following description of exemplary embodiments with reference to the attached drawings.

DESCRIPTION OF THE EMBODIMENTS (Embodiment 1)

(1) Fixing Apparatus (Image Heating Apparatus)

Figure 1:
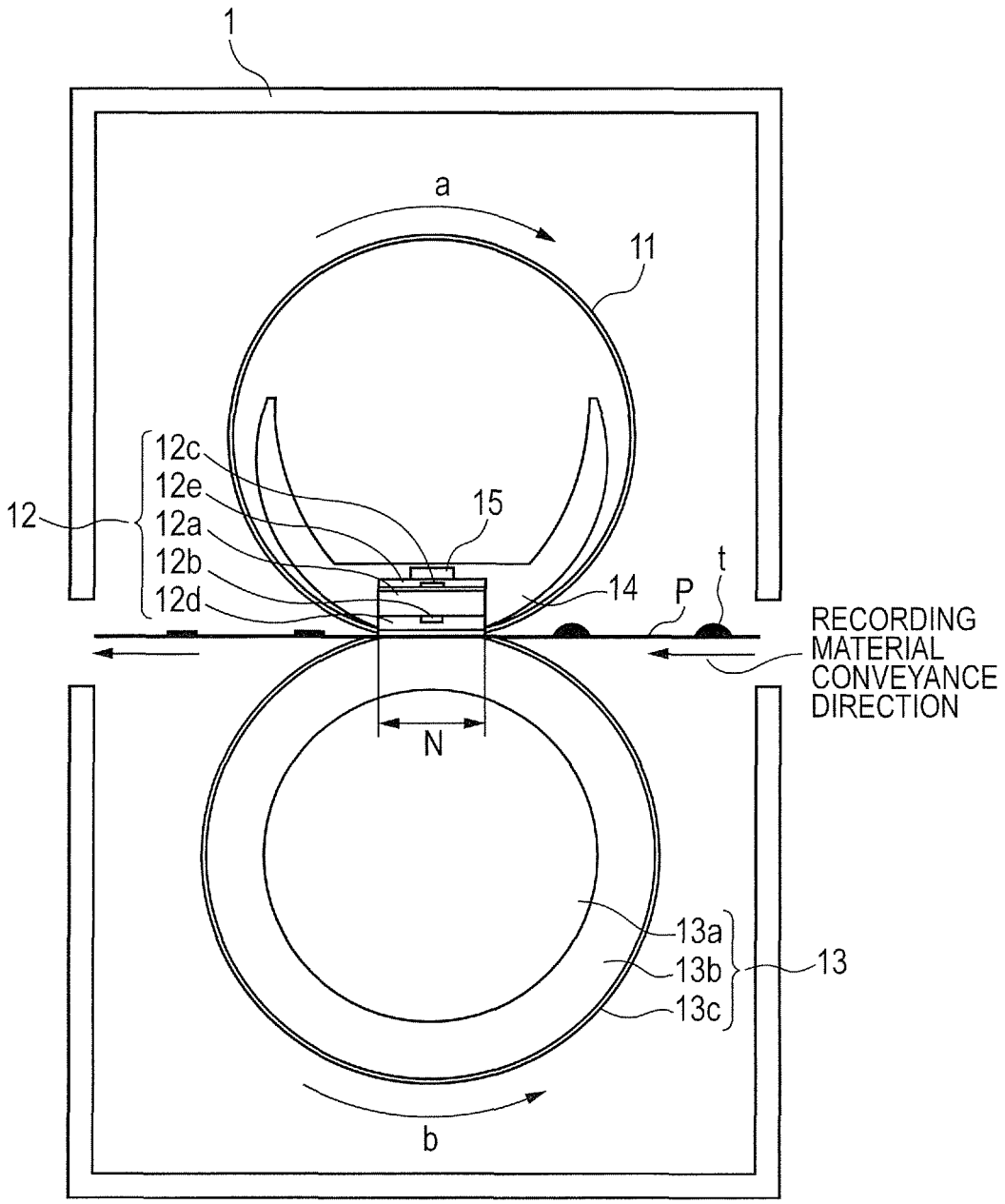
FIG. 1 is the schematic cross section view of the fixing apparatus.

Referring to FIG. 1, a configuration of a fixing apparatus is described. The fixing apparatus is mounted on an image forming apparatus such as an electrophotographic copying machine and an electrophotographic printer, and heats an unfixed toner image formed on a recording material at an image forming section of the image forming apparatus to heat-fix the toner image onto the recording material while nipping and conveying the recording material.

FIG. 1 is a schematic view of a traverse sectional configuration of the fixing apparatus as an image heating apparatus including a heating member according to the present invention.

In the following description, regarding the fixing apparatus and members constructing the fixing apparatus, a longitudinal direction refers to a direction orthogonal to a recording material conveyance direction in a plane of the recording material. A lateral direction refers to a direction parallel to the recording material conveyance direction in the plane of the recording material. A length refers to the dimension in the longitudinal direction. A width refers to the dimension in the lateral direction. Regarding the recording material, a width direction refers to a direction orthogonal to the recording material conveyance direction in the plane of the recording material. A width refers to the dimension in the width direction.

A fixing apparatus 1 of this embodiment includes a ceramic heater (hereinafter referred to as "heater") 12 as a heating member, a cylindrical fixing film 11 as a flexible member, a pressure roller 13 as a backup member, and a film guide 14 as a guide member. All of the heater 12, the fixing film 11, the pressure roller 13, and the film guide 14 are members long in the longitudinal direction.

The film guide 14 is formed into a substantially gutter shape in traverse cross section and is made of a heat resistant resin such as polyphenylene sulfide (PPS) and liquid crystal polymer (LCP). The film guide 14 guides the rotation of the fixing film 11 with its arc surface on a laterally outer side. The heater 12 is supported by a groove provided in the film guide 14 along the longitudinal direction at a lateral center of a lower surface of the film guide 14. The fixing film 11 is loosely fitted onto the outer periphery of the film guide 14 supporting the heater 12, and both longitudinal end portions of the film guide 14 are respectively supported by front and rear side plates (not shown) of an apparatus frame of the fixing apparatus 1.

The pressure roller 13 includes a round-shaft shaped core metal 13*a*, an elastic layer 13*b* provided on an outer peripheral surface of the core metal 13*a* between shaft portions provided at both longitudinal end portions thereof, and a release layer 13*c* provided on an outer peripheral surface of the elastic layer 13*b*. The core metal 13*a* is made of a metal material such as iron and aluminum. The elastic layer 13*b* is made of silicone rubber. The release layer 13*c* is made of a fluorine resin such as PFA.

The pressure roller 13 is arranged so as to be opposed to the heater 12 through intermediation of the fixing film 11, and the shaft portions of the core metal 13*a* at both the longitudinal end portions thereof are rotatably supported by the front and rear side plates of the apparatus frame of the fixing apparatus 1 through intermediation of bearings (not shown), respectively. The bearings are each biased by a pressure spring (not shown) in a direction orthogonal to a generating line direction of the fixing film 11, to thereby pressurize the pressure roller 13 to the heater 12 through intermediation of the fixing film 11. With this, the elastic layer 13*b* of the pressure roller 13 is elastically deformed toward the core metal 13*a*, to thereby form a fixing nip portion (nip portion) N with a predetermined width between the outer peripheral surface (surface) of the pressure roller 13 and the outer peripheral surface (surface) of the fixing film 11.

The thickness of the fixing film 11 is preferred to be about equal to or more than 20 μm and equal to or less than 1,000 μm in order to secure good heat conductivity. As the fixing film 11, a cylindrical single layer film made of a material such as polytetrafluoroethylene (PTFE), tetrafluoroethylene-perfluoroalkylvinylether (PFA), and polyphenylenesulfide (PPS) can be used.

Alternatively, a composite layer film can be used, in which, on a surface of a cylindrical base film made of a material such as PI, PAI, PEEK, and PES, a coating film such as PTFE, PFA, and FEP or a tube is provided as the release layer. PI is polyimide, PAI is polyamideimide, PEEK is polyetheretherketone, PES is polyethersulfone, and FEP is tetrafluoroethylene-hexafluoropropylene copolymer.

In this embodiment, the fixing film 11 having a total thickness of 75 μm was used, in which a PFA coating film of 15 μm was formed on PI having a diameter of 24 mm, a length of 240 mm, and a thickness of 60 μm. Further, the pressure roller 13 having a diameter of 25 mm, a length of 260 mm, and a pressure hardness of 50° (measured by ASKER Durometer Type C at 500 g load) was used.

(2) Heater (Heating Member) 12

Figure 2A:
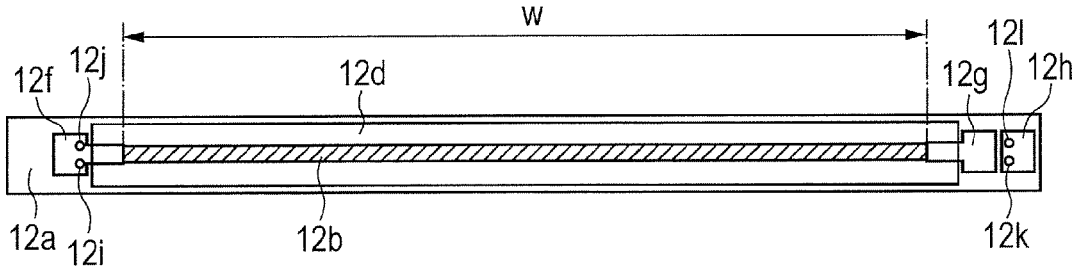
FIGS. 2A, 2B and 2C are views illustrating a heater according to Embodiment 1 of the present invention.
Figure 2B:
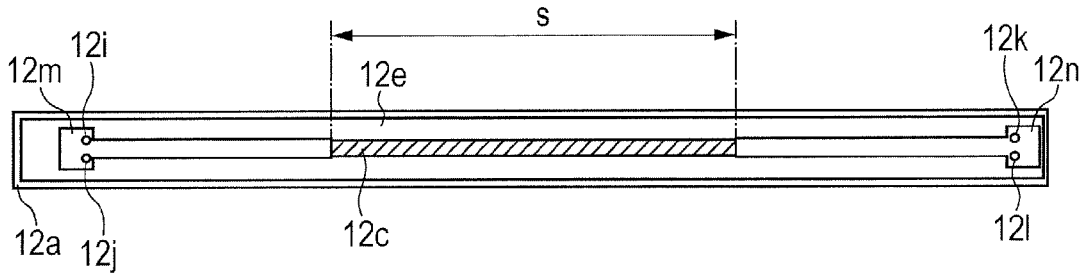
Figure 2C:
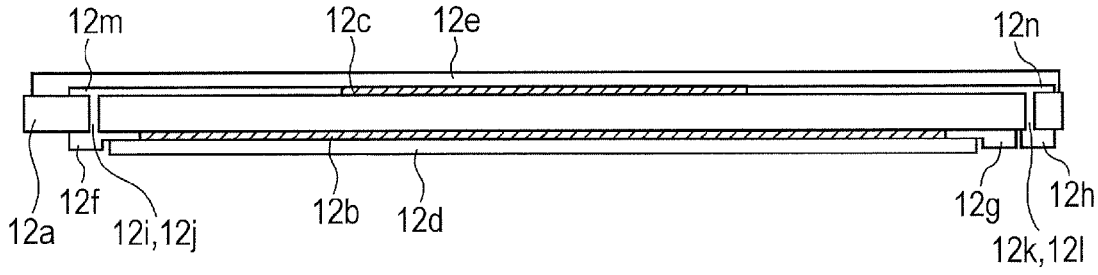

Referring to FIGS. 2A to 2C, the configuration of the heater 12 is described. FIG. 2A is a schematic view of the configuration of the heater 12 when the heater 12 is viewed from the fixing nip portion N side, and FIG. 2B is a schematic view of the configuration of the heater 12 when the heater 12 is viewed from a side opposite to the fixing nip portion N side. FIG. 2C is a schematic view of a vertical sectional configuration in the longitudinal direction passing through a through hole 12*i* (12*j*) and a through hole 12*k* (12*l*) of the heater 12.

The heater 12 includes an electrically insulated and elongated heater substrate (hereinafter referred to as "substrate") 12*a*. In each of FIGS. 2A to 2C, the portion of the heat generating resistor which generates heat through electrification is shown with a hatched area.

On one surface (hereinafter referred to as "front surface") of the substrate 12*a* on the fixing nip portion N side, the first heat generating resistor (hereinafter referred to as "heat generating resistor") 12*b* is provided on the substrate 12*a* along its longitudinal direction. Then, on an inner side of one longitudinal end portion of the substrate, there is provided a first power feeding electrode 12*f* electrically connected to one longitudinal end portion of the heat generating resistor 12*b*, and on an inner side of another longitudinal end portion of the substrate, there is provided a second power feeding electrode 12*h* which does not physically come into contact with another longitudinal end portion of the heat generating resistor 12*b*. On the further inner side of the another longitudinal end portion of the substrate 12*a*, there is provided a third power feeding electrode 12*g* electrically connected to the heat generating resistor 12*b*. The third power feeding electrode 12*g* is arranged on the longitudinal inner side of the substrate 12*a* with respect to the second power feeding electrode 12*h*.

Further, on the front surface of the substrate 12*a*, there is provided an insulated surface protective layer 12*d* for covering the heat generating resistor 12*b* and connection parts of the respective first power feeding electrode 12*f* and third power feeding electrode 12*g* with respect to the heat generating resistor 12*b*.

On another surface (hereinafter referred to as "back surface") of the substrate 12*a* on the side opposite to the fixing nip portion N side, the second heat generating resistor (hereinafter referred to as "heat generating resistor") 12*c* which generates heat through electrification is provided on the substrate 12*a* along its longitudinal direction. The heat generating resistor 12*c* is formed shorter than the heat generating resistor 12*b* and is arranged at substantially a center of the substrate 12*a* in the longitudinal direction. Then, on the inner side of the one longitudinal end portion of the substrate, there is provided a first conductor 12*m* electrically connected to one longitudinal end portion of the heat generating resistor 12*c*, and on the inner side of the another longitudinal end portion of the substrate, there is provided a second conductor 12*n* electrically connected to another longitudinal end portion of the heat generating resistor 12*c*. The first conductor 12*m* is arranged so as to be opposed to the first power feeding electrode 12*f* through intermediation of the substrate 12*a* in a thickness direction of the substrate 12*a*. The second conductor 12*n* is arranged so as to be opposed to the second power feeding electrode 12*h* through intermediation of the substrate 12*a* in the thickness direction of the substrate 12*a*.

Further, on the back surface of the substrate 12*a*, there is provided an insulated surface protective layer 12*e* for covering the heat generating resistor 12*c* and connection parts of the respective first conductor 12*m* and second conductor 12*n* with respect to the heat generating resistor 12*c*.

Further, the first power feeding electrode 12*f* and the first conductor 12*m* are electrically connected to each other via two through holes (multiple first through holes) 12*j* and 12*i* passing through the substrate 12*a* in the thickness direction of the substrate 12*a*. The second power feeding electrode 12*h* and the second conductor 12*n* are electrically connected to each other via two through holes (multiple second through holes) 12*k* and 12*l* passing through the substrate 12*a* in the thickness direction of the substrate 12*a*. Thus, the first power feeding electrode 12*f* is used as a common electrode for the two heat generating resistors 12*b* and 12*c*, and the second power feeding electrode 12*h* is used as a power feeding electrode for feeding power to the heat generating resistor 12*c* from the front surface of the substrate 12*a*.

The first power feeding electrode 12*f*, the second power feeding electrode 12*h*, and the third power feeding electrode 12*g* are electrically connected to power feeding connectors 16*a*, 16*e*, and 16*c* (see FIGS. 3A to 3C) as power feeding members, respectively. With this, power is fed from the power feeding connectors 16*a*, 16*e*, and 16*c* to the first power feeding electrode 12*f*, the second power feeding electrode 12*h*, and the third power feeding electrode 12*g*, and thus the heat generating resistors 12*b* and 12*c* generate heat.

In the following description, for the sake of simplicity, the first power feeding electrode 12*f*, the second power feeding electrode 12*h*, and the third power feeding electrode 12*g* are each referred to as "electrode", and the first conductor 12*m* and the second conductor 12*n* are each referred to as "conductor".

The substrate 12*a* may be made of ceramics such as alumina and aluminum nitride. In this embodiment, an alumina substrate having a lateral width of 7 mm, a longitudinal length of 280 mm, and a thickness of 1 mm was used.

The heat generating resistors 12*b* and 12*c* may be each formed by applying an electrical resistant material such as Ag/Pd, $RuO_2$, $Ta_2N$, graphite, SiC, and $LaCrO_3$ by screen printing into a linear or band pattern. Note that, Ag/Pd is silver-palladium, $RuO_2$ is ruthenium oxide, $Ta_2N$ is tantalum nitride, SiC is silicon carbide, and $LaCrO_3$ is lanthanum chromite.

In this embodiment, both of the heat generating resistors 12*b* and 12*c* were formed by screen printing of a material obtained by kneading Ag/Pd, glass powder, and an organic binder and then were subjected to baking. The heat generating resistor 12*c* was set to have a length s of 115 mm and a resistance of 30Ω. The heat generating resistor 12*b* was set to have a length w of 230 mm and a resistance of 15Ω. The heat generating resistor 12*c* was set to have a length corresponding to a small-sized recording material (recording sheet) having a small recording material width. The heat generating resistor 12*b* was set to have a length corresponding to a large-sized recording material (recording sheet) having a recording material width larger than that of the small-sized recording material.

The surface protective layers 12*d* and 12*e* are each formed for the purpose of securing insulation between the surface of the heater 12 and the heat generating resistor 12*b* or 12*c*. In this embodiment, an 80-μm insulated glass was formed by screen printing.

The electrodes 12*f*, 12*g*, and 12*h* and the conductors 12*m* and 12*n* may be each formed by screen printing of conductive paste having silver (Ag) or platinum (Pt) as a main component. Alternatively, conductive paste having gold (Au), a silver-platinum (Ag/Pt) alloy, or a silver-palladium (Ag/Pd) alloy as a main component can be used to form the electrodes and conductors by screen printing. In this embodiment, all of the electrodes and conductors were formed by screen printing of silver. Further, the electrodes 12*f*, 12*g*, and 12*h* and the conductors 12*m* and 12*n* are provided for the purpose of feeding power to the heat generating resistors 12*b* and 12*c*, and hence the electrical resistances thereof were set sufficiently smaller than those of the heat generating resistors 12*b* and 12*c*.

The through holes 12*i*, 12*j*, 12*k*, and 12*l* may be formed by a method of providing through holes through the substrate 12*a* at two positions (multiple positions) in an area of each of the electrodes 12*f* and 12*h* by laser scribing. Inside those through holes, conductive paste having silver (Ag), platinum (Pt), or gold (Au) as a main component may be provided to form conductive paths. Alternatively, inside those through holes, conductive paste having a silver-platinum (Ag/Pt) alloy or a silver-palladium (Ag/Pd) alloy as a main component may be provided to form the conductive paths. In this embodiment, the through holes were formed by laser scribing to have a diameter of 0.3 mm, and silver conductive paste was provided therein to form the conductive paths between the electrodes and the conductors.

(3) Heating and Fixing Operation of Fixing Apparatus

As illustrated in FIG. 1, in the fixing apparatus of this embodiment, the core metal 13*a* of the pressure roller 13 is rotated by the rotation and drive of a motor (not shown) so that the pressure roller 13 is rotated in the arrow b direction. The rotation of the pressure roller 13 is transmitted at the fixing nip portion N to the fixing film 11 by the frictional force generated between the surface of the pressure roller 13 and the surface of the fixing film 11. With this, the fixing film 11 rotates (moves) in the arrow a direction in accordance with the rotation of the pressure roller 13 while an inner peripheral surface (inside surface) of the fixing film 11 is brought into contact with the surface protective layer 12*d* of the heater 12.

When the large-sized recording material is subjected to heating and fixing of an unfixed toner image, an electrification control section (not shown) supplies power to the electrodes 12*f* and 12*g* of the heater 12 via the power feeding connectors 16*a* and 16*c*, and thus the heat generating resistor 12*b* generates heat. With this, the temperature of the heater 12 rapidly rises to heat the fixing film 11. The temperature of the heater 12 is detected by a temperature detection element (temperature detection member) 15 such as a thermistor provided at a predetermined position of the surface protective layer 12*e* on the back surface side of the substrate 12*a*. The electrification control section controls the electrification amount to the heater 12 based on an output signal from the temperature detection element 15 so that the heater 12 is maintained at a predetermined fixing temperature (target temperature).

Under a state in which the motor is rotated and driven and the heater 12 is maintained at a predetermined fixing temperature, a large-sized recording material P bearing an unfixed toner image t is introduced into the fixing nip portion N with a toner image bearing surface directed upward. The recording material P is nipped at the fixing nip portion N between the surface of the fixing film and the surface of the pressure roller 13, and is conveyed under this state (nipped and conveyed). In this conveyance process, the toner image t on the recording material P is heated to melt by the heater 12 through intermediation of the fixing film 11 and is pressurized at the fixing nip portion N. In this manner, the toner image t is heated and fixed onto the recording material. The recording material P having the toner image heated and fixed thereon has its toner image t separated from the surface of the fixing film 11 and is delivered out from the fixing nip portion N.

When the small-sized recording material is subjected to heating and fixing of an unfixed toner image, the electrification control section (not shown) supplies power to the electrodes 12*f* and 12*h* of the heater 12 via the power feeding connectors 16*a* and 16*e*, and thus the heat generating resistor 12*c* generates heat. With this, the temperature of the heater 12 rapidly rises to heat the fixing film 11. The temperature of the heater 12 is detected by the temperature detection element 15. The electrification control section controls the electrification amount to the heater 12 based on an output signal from the temperature detection element 15 so that the heater 12 is maintained at a predetermined fixing temperature.

Under a state in which the motor is rotated and driven and the heater 12 is maintained at a predetermined fixing temperature, a small-sized recording material P bearing an unfixed toner image t is introduced into the fixing nip portion N with a toner image bearing surface directed upward. The recording material P is nipped at the fixing nip portion N between the surface of the fixing film and the surface of the pressure roller 13, and is conveyed under this state (nipped and conveyed). In this conveyance process, the toner image t on the recording material P is heated to melt by the heater 12 through intermediation of the fixing film 11 and is pressurized at the fixing nip portion N. In this manner, the toner image t is heated and fixed onto the recording material. The recording material P having the toner image heated and fixed thereon has its toner image t separated from the surface of the fixing film 11 and is delivered out from the fixing nip portion N.

(4) Positional Relationships Among Through Holes of Heater and Power Feeding Contacts of Power Feeding Connectors In this embodiment, the through holes of the heater were formed at such positions that, when each power feeding connector (hereinafter referred to as "connector") including a power feeding contact was connected to the electrode, the shortest distances between the power feeding contact and periphery parts of the two through holes within the same electrode were substantially equal to each other. The purpose thereof is to equally divide and equalize the current amounts flowing through the two through holes, to thereby suppress the deterioration of the through holes.

Figure 3A:
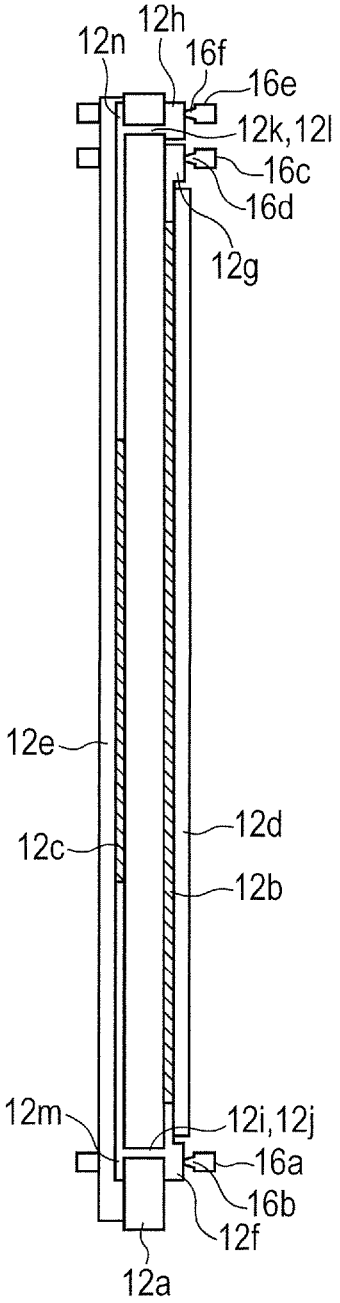
FIGS. 3A, 3B, 3C, 3D and 3E are views illustrating positional relationships among through holes and power feeding contacts when power feeding connectors are connected to a heater according to Embodiment 1 of the present invention.
Figure 3B:
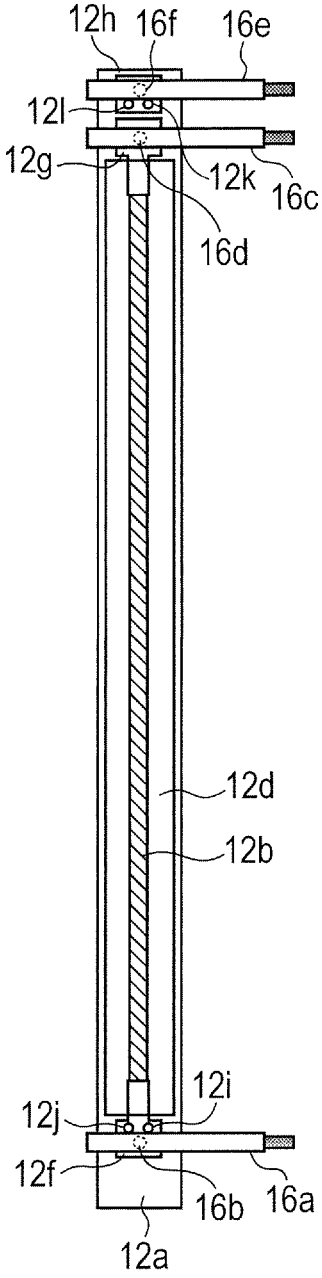
Figure 3C:
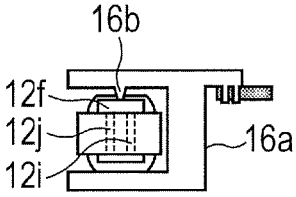

The positional relationships among the through holes and the power feeding contacts in this embodiment are described with reference to FIGS. 3A, 3B, and 3C. FIGS. 3A, 3B, and 3C are views illustrating the positional relationships among the through holes and the power feeding contacts when the connectors 16*a*, 16*c*, and 16*e* are connected to the heater 12. FIG. 3A is a view illustrating positional relationships among the through holes 12*i*, 12*j*, 12*k*, and 12*l* and power feeding contacts 16*b*, 16*d*, and 16*f* when viewed from the downstream side of the recording material conveyance direction. FIG. 3B is a view illustrating the positional relationships among the through holes 12*i*, 12*j*, 12*k*, and 12*l* and the power feeding contacts 16*b*, 16*d*, and 16*f* when viewed from the fixing nip portion N side.

Figure 3D:
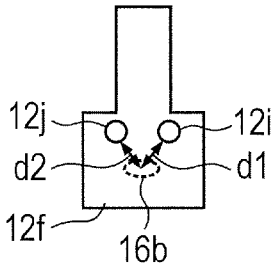
Figure 3E:
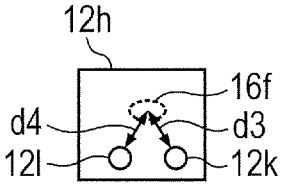

FIG. 3C is a view illustrating positional relationships among the through holes 12*i* and 12*j* and the power feeding contact 16*b* when viewed from the electrode 12*f* side. FIG. 3D is a view illustrating positional relationships among the through holes 12*i* and 12*j* and the power feeding contact 16*b* at the electrode 12*f* when viewed from the fixing nip portion N side. FIG. 3E is a view illustrating positional relationships among the through holes 12*k* and 12*l* and the power feeding contact 16*f* at the electrode 12*h* when viewed from the fixing nip portion N side. In each of FIGS. 3A and 3B, the portion of the heat generating resistor which generates heat through electrification is also shown with a hatched area. In each of FIGS. 3B and 3C, lead wires shown with solid areas are supported by the power feeding connectors 16*c*, 16*e*. The connectors 16*a*, 16*c*, and 16*e* include the power feeding contacts 16*b*, 16*d*, and 16*f* for forming electrical conduction while being brought into press contact with the electrodes 12*f*, 12*g*, and 12*h* of the heater 12, respectively. In this embodiment, the connectors 16*a*, 16*c*, and 16*e* were each inserted to the heater 12 supported by the film guide 14 from the right direction in FIG. 3B, that is, the upstream side of the recording material conveyance direction, and the film guide 14 (not shown) was used for positioning and preventing the connectors from slipping out. With this, the positions of the power feeding contacts 16*b*, 16*d*, and 16*f* were determined with respect to the electrodes 12*f*, 12*g*, and 12*h* on the heater 12. With this configuration, relationships of distances among the power feeding contacts 16*b*, 16*d*, and 16*f* and the through holes 12*i*, 12*j*, 12*k*, and 12*l* were determined.

As illustrated in FIG. 3D, when the shortest distance between the power feeding contact 16*b* and the periphery part of the through hole 12*i* was defined as d1 and the shortest distance between the power feeding contact 16*b* and the periphery part of the through hole 12*j* was defined as d2, d1 and d2 were set to be substantially equal to each other. As illustrated in FIG. 3E, when the shortest distance between the power feeding contact 16*f* and the periphery part of the through hole 12*k* was defined as d3 and the shortest distance between the power feeding contact 16*f* and the periphery part of the through hole 12*l* was defined as d4, d3 and d4 were set to be substantially equal to each other. In this embodiment, d1 and d2 were both set to 2 mm, and d3 and d4 were both set to 2 mm.

Figure 4:
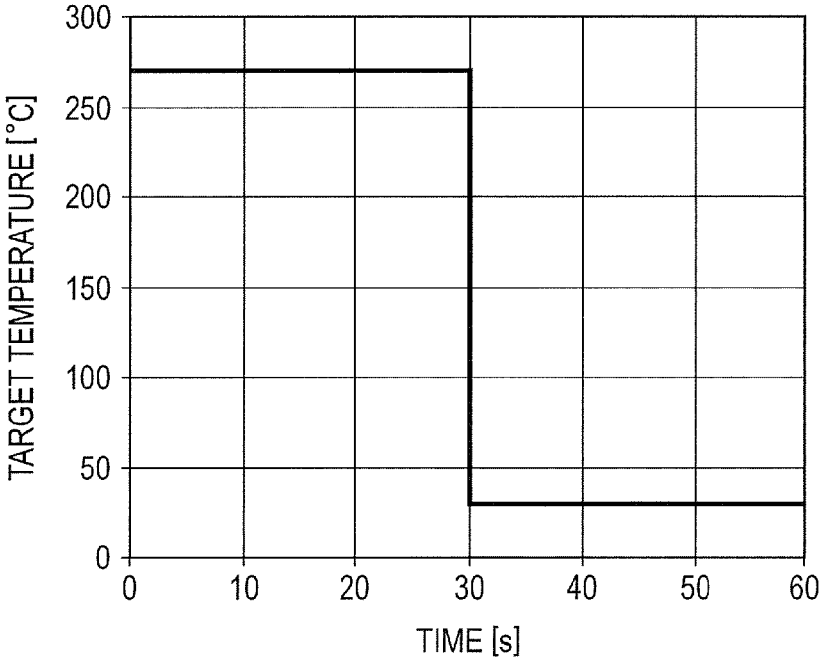
FIG. 4 shows a temperature variation at the evaluation test of a heater according to Embodiment 1.
Figure 5A:
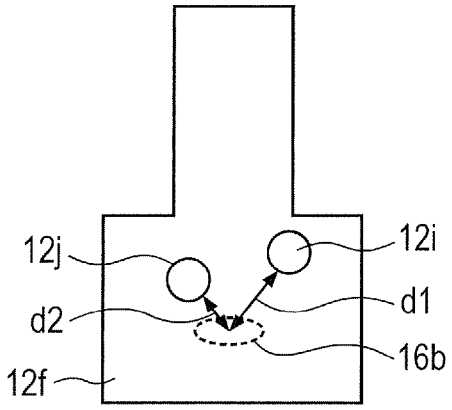
FIGS. 5A and 5B show positions of through-holes on electrodes of a heater in a comparative example with respect to Embodiment 1.
Figure 5B:
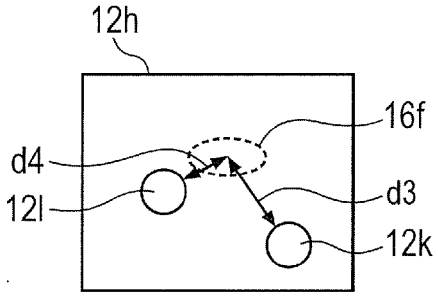

Next, in order to confirm the effects obtained through the use of the above-mentioned configuration, the reliability of the electrification of the heater 12 was tested. The test was performed by the following method. Under a state in which the heater 12 was incorporated in the fixing apparatus, electrification and non-electrification were repeated based on the detection results of the temperature detection element 15 with the temperature target as shown in FIG. 4 set as one cycle. The reliability was evaluated based on the number of times of the testing cycles when the resistance of the through hole increased and the conduction reduced. Further, as a comparative example, a heater having such an electrode configuration that the through hole positions satisfied d1>d2 and d3>d4 as illustrated in FIGS. 5A and 5B was similarly subjected to the testing. The heater of the comparative example was used for comparison under setting conditions of d1=2.3 mm, d2=1.8 mm, d3=2.3 mm, and d4=1.8 mm, and setting conditions of d1=2.5 mm, d2=1.5 mm, d3=2.5 mm, and d4=1.5 mm. Respective evaluation results are shown in Table 1.

TABLE 1

Difference of electrification performance depending on through hole positions

| Distance between through hole and power feeding contact | Number of testing times |
|---|---|
| d1 = d2 = 2 mm, d3 = d4 = 2 mm | 5,000 times |
| d1 = 2.3 mm, d2 = 1.8 mm, d3 = 2.3 mm, d4 = 1.8 mm | 4,800 times |
| d1 = 2.5 mm, d2 = 1.5 mm, d3 = 2.5 mm, d4 = 1.5 mm | 3,700 times |

As shown in Table 1, with the configuration of d1=d2 and d3=d4, the heater 12 achieved 1.4 times longer life in the number of testing times than the configuration of d1=2.5 mm, d2=1.5 mm, d3=2.5 mm, and d4=1.5 mm. That is, by adopting the configuration of d1=d2 and d3=d4 as in the heater 12 of this embodiment, the reliability of the electrification of the heater using the through holes was increased. Further, the configuration set to d1=2.3 mm, d2=1.8 mm, d3=2.3 mm, and d4=1.8 mm differed from the configuration of d1=d2 and d3=d4 only by 200 times. Thus, when the difference in distances between the power feeding contact and the two through holes is limited to about 0.5 mm, sufficient reliability can be obtained, but the distances are preferred to be set equal to each other.

In this evaluation, in the configuration of d1>d2 and d3>d4, such a tendency was observed that the through hole having a smaller distance first deteriorated and the resistance thereof increased, and immediately after that, the through hole having a larger distance also deteriorated due to current concentration. However, in the configuration of d1=d2 and d3=d4, the currents flowed in a well-balanced manner, and hence it was possible to increase the number of times taken until deterioration, and it was confirmed that the intended effects were obtained. Therefore, in the heater 12 of this embodiment, the burning of the through hole and the conduction failure caused by the burning can be prevented.

This testing was a mode of evaluating the reliability of the heater at an accelerated rate, and even in the heater of this embodiment, the conduction tended to be reduced. However, when the heater of this embodiment was used in the fixing apparatus of the image forming apparatus, no rise in resistance along with the deterioration of the through hole was observed in the same number of times, and there was no problem for actual use.

In the heater 12 of this embodiment, even when the electrodes 12*f*, 12*g*, and 12*h* and the conductors 12*m* and 12*n* are arranged on the inner side of the one longitudinal end portion of the substrate 12*a*, similar actions and effects can be obtained. Alternatively, even when the electrodes 12*f*, 12*g*, and 12*h* and the conductors 12*m* and 12*n* are arranged on the inner side of the another longitudinal end portion of the substrate 12*a*, similar actions and effects can be obtained.

In the heater 12 of this embodiment, even when the heat generating resistor 12*b* and the electrode 12*g* are not provided, similar actions and effects can be obtained. In this case, the electrode 12*f* is not used as the common electrode, and is used as a power feeding electrode for feeding power to the heat generating resistor 12*c* from the front surface of the substrate 12*a*. The heater 12 in this case includes the substrate 12*a*, the electrodes 12*f* and 12*h*, the heat generating resistor 12*c*, the conductors 12*m* and 12*n*, and the through holes 12*i*, 12*j*, 12*k*, and 12*l*, and d1=d2 and d3=d4 are satisfied. With this, the burning of the through hole and the conduction failure caused by the burning can be prevented.

Further, in the case where the heat generating resistor 12*b* and the electrode 12*g* are not provided in the heater 12 of this embodiment, even when the heat generating resistor 12*c* is set to have the same length as the heat generating resistor 12*b*, similar actions and effects can be obtained.

Further, in the case where the heat generating resistor 12*b* and the electrode 12*g* are not provided in the heater 12 of this embodiment, even when the electrodes 12*f* and 12*h* and the conductors 12*m* and 12*n* are arranged on the inner side of the one longitudinal end portion of the substrate 12*a*, similar actions and effects can be obtained. Alternatively, even when the electrodes 12*f* and 12*h* and the conductors 12*m* and 12*n* are arranged on the inner side of the another longitudinal end portion of the substrate 12*a*, similar actions and effects can be obtained.

(Embodiment 2)

Figure 6A:
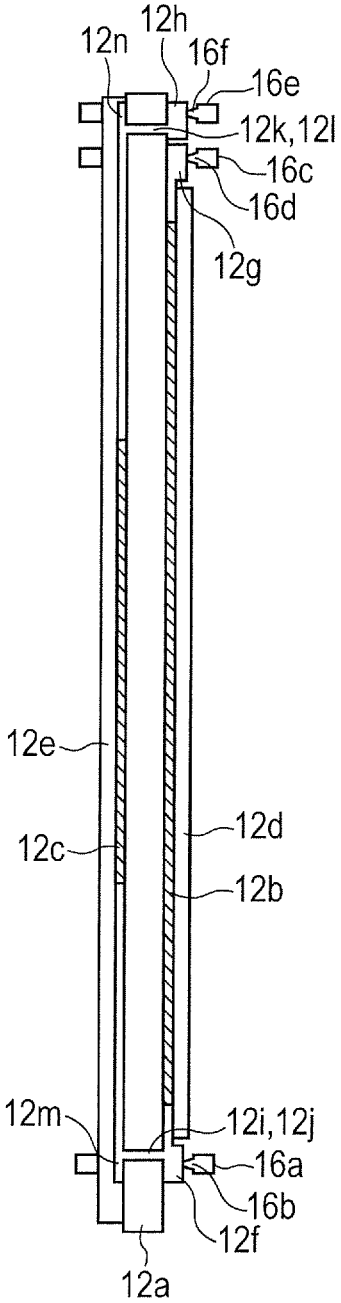
FIGS. 6A, 6B, 6C, 6D, and 6E are views illustrating positional relationships among through holes and power feeding contacts when power feeding connectors are connected to a heater according to Embodiment 2 of the present invention.
Figure 6B:
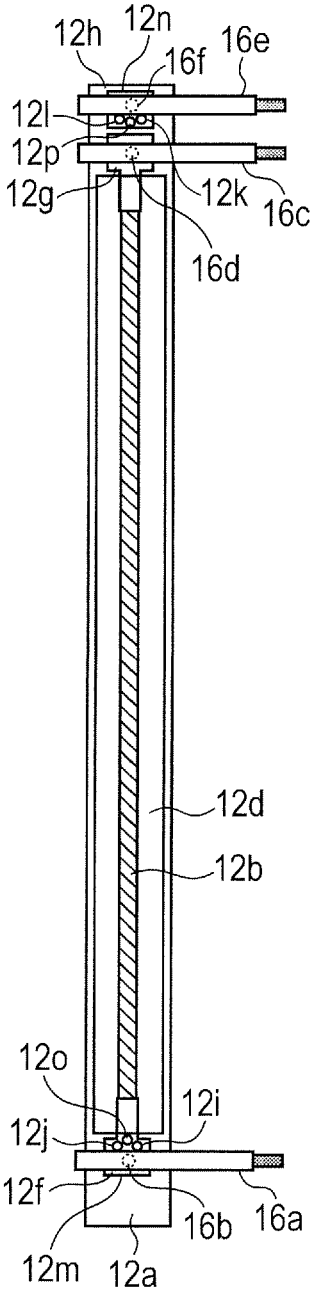

Another embodiment of the heater is described. In the heater of this embodiment, as illustrated in FIGS. 6A and 6B, the electrode 12*f* and the conductor 12*m* are electrically connected to each other via three through holes (multiple first through holes) 12*j*, 12*i*, and 12*o* passing through the substrate 12*a* in the thickness direction of the substrate 12*a*. Similarly, the electrode 12*h* and the conductor 12*n* are electrically connected to each other via three through holes (multiple second through holes) 12*k*, 12*l*, and 12*p* passing through the substrate 12*a* in the thickness direction of the substrate 12*a*. The heater has the same configuration as the heater 12 of Embodiment 1 except for those points.

The configuration of the heater of this embodiment and the positional relationships among the through holes and the power feeding contacts are illustrated in FIGS. 6A to 6E. FIG. 6A is a view illustrating positional relationships among the through holes 12*i*, 12*j*, 12*o*, 12*k*, 12*l*, and 12*p* and the power feeding contacts 16*b*, 16*d*, and 16*f* when viewed from the downstream side of the recording material conveyance direction. FIG. 6B is a view illustrating the positional relationships among the through holes 12*i*, 12*j*, 12*o*, 12*k*, 12*l*, and 12*p* and the power feeding contacts 16*b*, 16*d*, and 16*f* when viewed from the fixing nip portion N side. In each of FIGS. 6A and 6B, the portion of the heat generating resistor which generates heat through electrification is also shown with a hatched area.

Figure 6C:
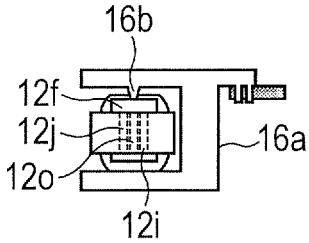
Figure 6D:
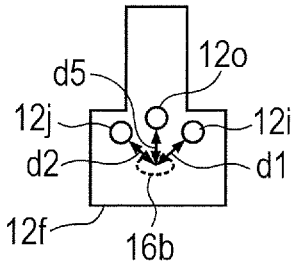
Figure 6E:
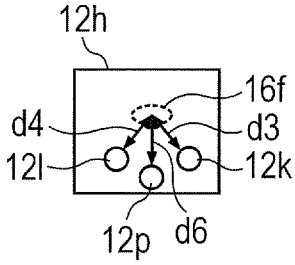

FIG. 6C is a view illustrating positional relationships among the through holes 12*i*, 12*j*, and 12*o* and the power feeding contact 16*b* when viewed from the electrode 12*f* side. FIG. 6D is a view illustrating positional relationships among the through holes 12*i*, 12*j*, and 12*o* and the power feeding contact 16*b* at the electrode 12*f* when viewed from the fixing nip portion N side. FIG. 6E is a view illustrating positional relationships among the through holes 12*k*, 12*l*, and 12*p* and the power feeding contact 16*f* at the electrode 12*h* when viewed from the fixing nip portion N side. In each of FIGS. 6B and 6C, lead wires shown with solid area are supported by the power feeding connectors 16*c*, 16*e*.

In this embodiment, the through holes 12*o* and 12*p* were added to the heater of Embodiment 1. When the shortest distances between the power feeding contact and periphery parts of the respective through holes 12*o* and 12*p* were defined as d5 and d6, the distance relationships were set to d1=d2=d5 and d3=d4=d6. The distances d1, d2, and d5 were all set to 1.8 mm, and the distances d3, d4, and d6 were all set to 1.6 mm.

Figure 7A:
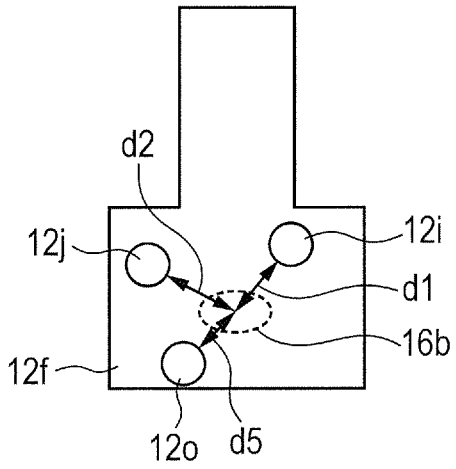
FIGS. 7A and 7B are views illustrating positions of through holes on an electrode of a heater according to a comparative example with respect to Embodiment 2.
Figure 7B:
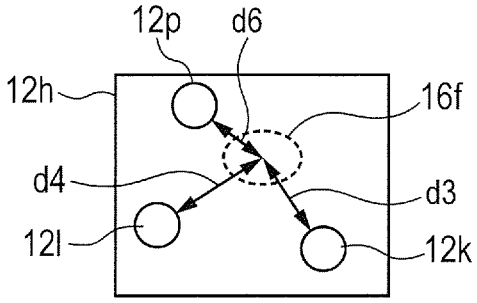

In order to confirm the effects obtained by using the above-mentioned configuration, reliability of the electrification of the heater 12 was tested under conditions similar to those of Embodiment 1. Further, as a comparative example, a heater having a configuration satisfying d1>d5>d2 and d3>d6>d4, as illustrated in FIGS. 7A and 7B, was similarly subjected to the testing. The heater of the comparative example was used under setting conditions of d1=1.8 mm, d2=2.0 mm, d5=1.5 mm, d3=1.6 mm, d4=1.8 mm, and d6=1.3 mm. Further, another heater of the comparative example was used under setting conditions of d1=1.8 mm, d2=2.3 mm, d5=1.3 mm, d3=1.6 mm, d4=2.1 mm, and d6=1.1 mm. The heater 12 was then compared to the two heaters of the comparative example. Respective evaluation results are shown in Table 2.

TABLE 2

| Difference of electrification performance depending on through hole positions | |
|---|---|
| Distance between through hole and power feeding contact | Number of testing times |
| d1 = d2 = d5 = 1.8 mm, d3 = d4 = d6 = 1.6 mm | 8,000 times |
| d1 = 1.8 mm, d2 = 2.0 mm, d5 = 1.5 mm, d3 = 1.6 mm, d4 = 1.8 mm, d6 = 1.3 mm | 7,700 times |
| d1 = 1.8 mm, d2 = 2.3 mm, d5 = 1.3 mm, d3 = 1.6 mm, d4 = 2.1 mm, d6 = 1.1 mm | 4,300 times |

As shown in Table 2, with the configuration of d1=d2=d5 and d3=d4=d6, the heater 12 achieved 1.9 times longer life than the configuration of d1=1.8 mm, d2=2.3 mm, d5=1.3 mm, d3=1.6 mm, d4=2.1 mm and d6=1.1 mm. That is, by adopting the configuration of d1=d2=d5 and d3=d4=d6 as in the heater 12 of this embodiment, the reliability of the electrification of the heater using the through holes was increased. Further, the configuration set to d1=1.8 mm, d2=2.0 mm, d5=1.5 mm, d3=1.6 mm, d4=1.8 mm, and d6=1.3 mm differed from the configuration of d1=d2=d5 and d3=d4=d6 only by 300 times. Thus, also in the configuration including the three through holes, when the difference in distances between the power feeding contact and the closest one of the through holes and between the power feeding contact and the farthest one of the through holes is limited to about 0.5 mm, sufficient reliability can be obtained, but the distances are preferred to be set equal to each other.

In this evaluation, in the configuration of d1>d5>d2 and d3>d6>d4, such a tendency was observed that the through hole having a smaller distance first deteriorated and the resistance thereof increased, and immediately after that, the through hole having a larger distance also deteriorated due to current concentration. However, in the configuration of d1=d2=d5 and d3=d4=d6, the currents flowed in a well-balanced manner, and hence it was possible to increase the number of times taken until deterioration, and it was confirmed that the intended effects were obtained. Therefore, also in the heater 12 of this embodiment, the burning of the through hole and the conduction failure caused by the burning can be prevented.

This testing was a mode of evaluating the reliability of the heater at an accelerated rate, and even in the heater of this embodiment, the conduction tended to be reduced. However, when the heater of this embodiment was used in the fixing apparatus of the image forming apparatus, no rise in resistance along with the deterioration of the through hole was observed in the same number of times, and there was no problem for actual use.

Further, as compared to the heater 12 of Embodiment 1, the heater 12 of this embodiment achieved a longer life by 3,000 times in the number of testing times, and such an effect was confirmed that, by increasing the number of through holes, the reliability was increased. That is, although the number of through holes in Embodiment 1 was 2 and the number of through holes in this embodiment was 3, it is easy to presume that, even in a configuration in which the number of through holes is further increased, the reliability of the electrification of the heater can be increased.

In the heater 12 of this embodiment, even when the electrodes 12*f*, 12*g*, and 12*h* and the conductors 12*m* and 12*n* are arranged on the inner side of the one longitudinal end portion of the substrate 12*a*, similar actions and effects can be obtained. Alternatively, even when the electrodes 12*f*, 12*g*, and 12*h* and the conductors 12*m* and 12*n* are arranged on the inner side of the another longitudinal end portion of the substrate 12*a*, similar actions and effects can be obtained.

In the heater 12 of this embodiment, even when the heat generating resistor 12*b* and the electrode 12*g* are not provided, similar actions and effects can be obtained. In this case, the electrode 12*f* is not used as the common electrode, and is used as a power feeding electrode for feeding power to the heat generating resistor 12*c* from the front surface of the substrate 12*a*. The heater 12 in this case includes the substrate 12*a*, the electrodes 12*f* and 12*h*, the heat generating resistor 12*c*, the conductors 12*m* and 12*n*, and the through holes 12*i*, 12*j*, 12*o*, 12*k*, 12*l*, and 12*p*, and d1=d2=d5 and d3=d4=d6 are satisfied. With this, the burning of the through hole and the conduction failure caused by the burning can be prevented.

Further, in the case where the heat generating resistor 12*b* and the electrode 12*g* are not provided in the heater 12 of this embodiment, even when the heat generating resistor 12*c* is set to have the same length as the heat generating resistor 12*b*, similar actions and effects can be obtained.

Further, in the case where the heat generating resistor 12*b* and the electrode 12*g* are not provided in the heater 12 of this embodiment, even when the electrodes 12*f* and 12*h* and the conductors 12*m* and 12*n* are arranged on the inner side of the one longitudinal end portion of the substrate 12*a*, similar actions and effects can be obtained. Alternatively, even when the electrodes 12*f* and 12*h* and the conductors 12*m* and 12*n* are arranged on the inner side of the another longitudinal end portion of the substrate 12*a*, similar actions and effects can be obtained.

(Embodiment 3)

Another embodiment of the heater is described. The heater of this embodiment is configured so that two power feeding contacts are present for each of the electrodes 12*f* and 12*h*. The heater has the same configuration as the heater 12 of Embodiment 1 except for this point.

Figure 8A:
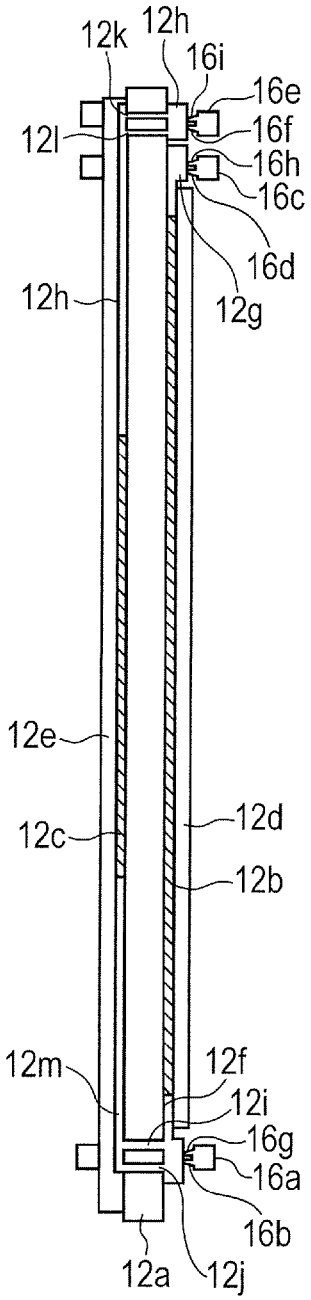
FIGS. 8A, 8B, 8C, 8D, and 8E are views illustrating positional relationships among through holes and power feeding contacts when power feeding connectors are connected to a heater according to Embodiment 3 of the present invention.
Figure 8B:
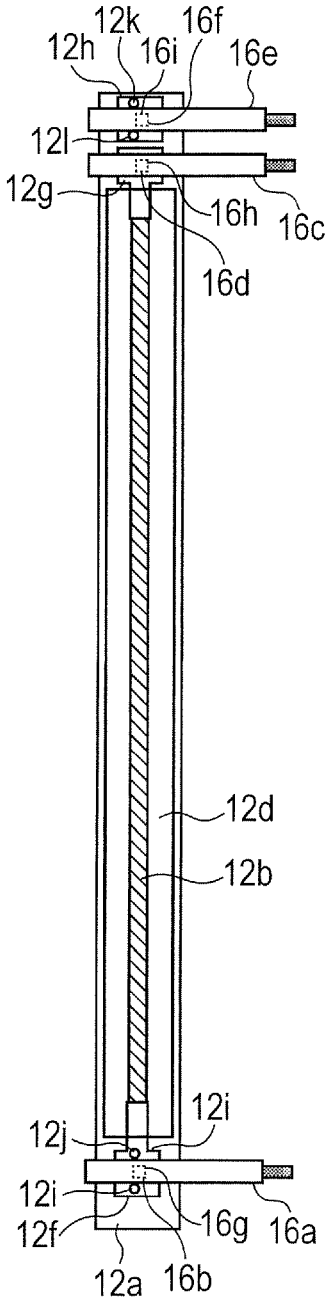

The configuration of the heater of this embodiment and the positional relationships among the through holes and the power feeding contacts are illustrated in FIGS. 8A, 8B, 8C, 8D, and 8E. FIG. 8A is a view illustrating positional relationships among the through holes 12*i*, 12*j*, 12*k*, and 12*l* and power feeding contacts 16*b*, 16*g*, 16*d*, 16*f*, and 16*i* when viewed from the downstream side of the recording material conveyance direction. FIG. 8B is a view illustrating the positional relationships among the through holes 12*i*, 12*j*, 12*k*, and 12*l* and the power feeding contacts 16*b*, 16*g*, 16*d*, 16*f*, and 16*i* when viewed from the fixing nip portion N side. In each of FIGS. 8A and 8B, the portion of the heat generating resistor which generates heat through electrification is also shown with a hatched area.

Figure 8C:
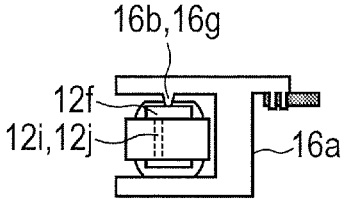
Figure 8D:
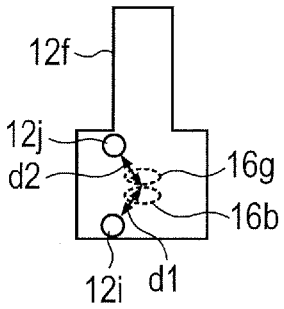
Figure 8E:
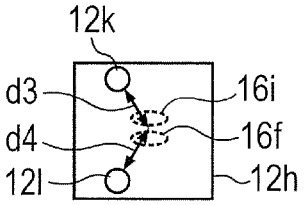

FIG. 8C is a view illustrating positional relationships among the through holes 12*i* and 12*j* and the power feeding contacts 16*b* and 16*g* when viewed from the electrode 12*f* side. FIG. 8D is a view illustrating positional relationships among the through holes 12*i* and 12*j* and the power feeding contacts 16*b* and 16*g* at the electrode 12*f* when viewed from the fixing nip portion N side. FIG. 8E is a view illustrating positional relationships among the through holes 12*k* and 12*l* and the power feeding contacts 16*f* and 16*i* at the electrode 12*h* when viewed from the fixing nip portion N side. In each of FIGS. 8B and 8C, lead wires shown with solid areas are supported by the power feeding connectors 16*c*, 16*e*.

In the heater 12 of this embodiment, power feeding contacts 16*g*, 16*h*, and 16*i* were added to the connectors 16*a*, 16*c*, and 16*e*, respectively, in the configuration of the heater 12 of Embodiment 1. With this, two power feeding contacts (multiple power feeding contacts) 16*b* and 16*g* of the connector 16*a* are electrically connected to the electrode 12*f* within the area of the electrode 12*f*. On the other hand, two power feeding contacts (multiple power feeding contacts) 16*f* and 16*i* of the connector 16*e* are electrically connected to the electrode 12*h* within the area of the electrode 12*h*. In this configuration, the number of power feeding contacts present in one electrode is increased, and thus reliability of conduction performance is intended to be increased with respect to fluctuations in abutment degree and in power feeding performance of each power feeding contact.

Further, the positional relationships among the through holes and the power feeding contacts in the two electrodes 12*f* and 12*h* were set so that the shortest distances from the middle point of the two power feeding contacts to the periphery parts of the through holes were substantially equal to each other. That is, as illustrated in FIG. 8D, when the shortest distance between the middle point of the power feeding contacts 16*b* and 16*g* and the periphery part of the through hole 12*i* was defined as d1 and the shortest distance between the middle point of the power feeding contacts 16*b* and 16*g* and the periphery part of the through hole 12*j* was defined as d2, d1 and d2 were set to be substantially equal to each other.

As illustrated in FIG. 8E, when the shortest distance between the middle point of the power feeding contacts 16*f* and 16*i* and the periphery part of the through hole 12*k* was defined as d3, and the shortest distance between the middle point of the power feeding contacts 16*f* and 16*i* and the periphery part of the through hole 12*l* was defined as d4, d3 and d4 were set to be substantially equal to each other. In this embodiment, both of d1 and d2 were set to 2 mm, and both of d3 and d4 were set to 2 mm.

Figure 9A:
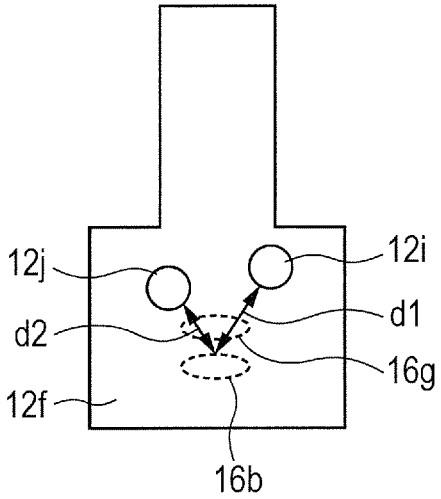
FIGS. 9A and 9B are views illustrating positions of through holes on an electrode of a heater according to a comparative example with respect to Embodiment 3.
Figure 9B:
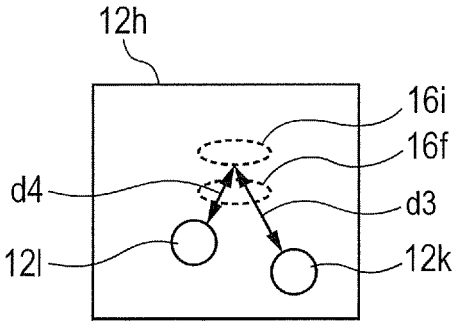

In order to confirm the effects obtained by using the above-mentioned configuration, reliability of electrification of the heater 12 was tested under conditions similar to those of Embodiment 1. Further, as a comparative example, a heater having such an electrode configuration that the through hole positions satisfied d1>d2 and d3>d4 as illustrated in FIGS. 9A and 9B was similarly subjected to the testing. The heater of the comparative example was used for comparison under setting conditions of d1=2.3 mm, d2=1.8 mm, d3=2.3 mm, and d4=1.8 mm, and setting conditions of d1=2.5 mm, d2=1.5 mm, d3=2.5 mm, and d4=1.5 mm. Respective evaluation results are shown in Table 3.

TABLE 3

Difference of electrification performance depending on through hole positions

| Distance between through hole and power feeding contact | Number of testing times |
|---|---|
| d1 = d2 = 2 mm, d3 = d4 = 2 mm | 6,000 times |
| d1 = 2.3 mm, d2 = 1.8 mm, d3 = 2.3 mm, d4 = 1.8 mm | 5,800 times |
| d1 = 2.5 mm, d2 = 1.5 mm, d3 = 2.5 mm, d4 = 1.5 mm | 4,500 times |

As shown in Table 3, with the configuration of d1=d2 and d3=d4, the heater 12 achieved 1.3 times longer life in the number of testing times than the configuration of d1=2.5 mm, d2=1.5 mm, d3=2.5 mm, and d4=1.5 mm. That is, by adopting the configuration of d1=d2 and d3=d4 as in the heater 12 of this embodiment, the reliability of the electrification of the heater using the through holes was increased. Further, even in the configuration of the heater 12 of this embodiment in which two power feeding contacts are present in each of the electrodes 12*f* and 12*h*, when the difference in distances between the middle point of the power feeding contacts and the two through holes is limited to about 0.5 mm, sufficient reliability can be obtained. The distances between the middle point of the power feeding contacts and the two through holes are preferred to be set equal to each other. Thus, also in the heater 12 of this embodiment, the burning of the through hole and the conduction failure caused by the burning can be prevented.

This testing was a mode of evaluating the reliability of the heater at an accelerated rate, and even in the heater of this embodiment, the conduction tended to be reduced. However, when the heater of this embodiment was used in the fixing apparatus of the image forming apparatus, no rise in resistance along with the deterioration of the through hole was observed in the same number of times, and there was no problem for actual use.

Further, the heater of this embodiment had a larger number of power feeding contacts than that of the heater 12 of Embodiment 1, and thus the heater of this embodiment achieved a longer life by 1,000 times in the number of testing times as compared to the heater 12 of Embodiment 1. Therefore, such an effect was confirmed that, by increasing the number of power feeding contacts, the reliability of the electrification of the heater was increased. That is, although the number of power feeding contacts in Embodiment 1 was 1 and the number of power feeding contacts in this embodiment was 2, it is easy to presume that, even in a configuration in which the number of power feeding contacts is further increased, the reliability of the electrification of the heater can be increased.

In the heater 12 of this embodiment, even when the electrodes 12*f*, 12*g*, and 12*h* and the conductors 12*m* and 12*n* are arranged on the inner side of the one longitudinal end portion of the substrate 12*a*, similar actions and effects can be obtained. Alternatively, even when the electrodes 12*f*, 12*g*, and 12*h* and the conductors 12*m* and 12*n* are arranged on the inner side of the another longitudinal end portion of the substrate 12*a*, similar actions and effects can be obtained.

In the heater 12 of this embodiment, even when the heat generating resistor 12*b* and the electrode 12*g* are not provided, similar actions and effects can be obtained. In this case, the electrode 12*f* is not used as the common electrode, and is used as a power feeding electrode for feeding power to the heat generating resistor 12*c* from the front surface of the substrate 12*a*. The heater 12 in this case includes the substrate 12*a*, the electrodes 12*f* and 12*h*, the heat generating resistor 12*c*, the conductors 12*m* and 12*n*, and the through holes 12*i*, 12*j*, 12*k*, and 12*l*, and d1=d2 and d3=d4 are satisfied. With this, the burning of the through hole and the conduction failure caused by the burning can be prevented.

Further, in the case where the heat generating resistor 12*b* and the electrode 12*g* are not provided in the heater 12 of this embodiment, even when the heat generating resistor 12*c* is set to have the same length as the heat generating resistor 12*b*, similar actions and effects can be obtained.

Further, in the case where the heat generating resistor 12*b* and the electrode 12*g* are not provided in the heater 12 of this embodiment, even when the electrodes 12*f* and 12*h* and the conductors 12*m* and 12*n* are arranged on the inner side of the one longitudinal end portion of the substrate 12*a*, similar actions and effects can be obtained. Alternatively, even when the electrodes 12*f* and 12*h* and the conductors 12*m* and 12*n* are arranged on the inner side of the another longitudinal end portion of the substrate 12*a*, similar actions and effects can be obtained.

(Embodiment 4)

Another embodiment of the heater is described. The heater of this embodiment is configured so that not only the distances between the middle point of the power feeding contacts and the through holes but also the distances between the one longitudinal end portion of the heat generating resistor and the through holes as well as the distances between the another longitudinal end portion of the same heat generating resistor and the through holes are each substantially equal to each other. The heater of this embodiment has the same configuration as the heater 12 of Embodiment 1 except for the above-mentioned configuration.

Figure 10A:
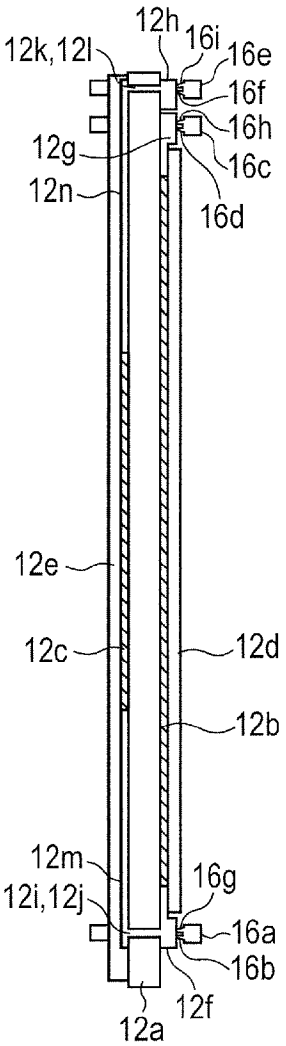
FIGS. 10A, 10B, 10C, 10D, 10E, and 10F are views illustrating positional relationships among heat generating resistors, through holes, and power feeding contacts when power feeding connectors are connected to a heater according to Embodiment 4 of the present invention.
Figure 10B:
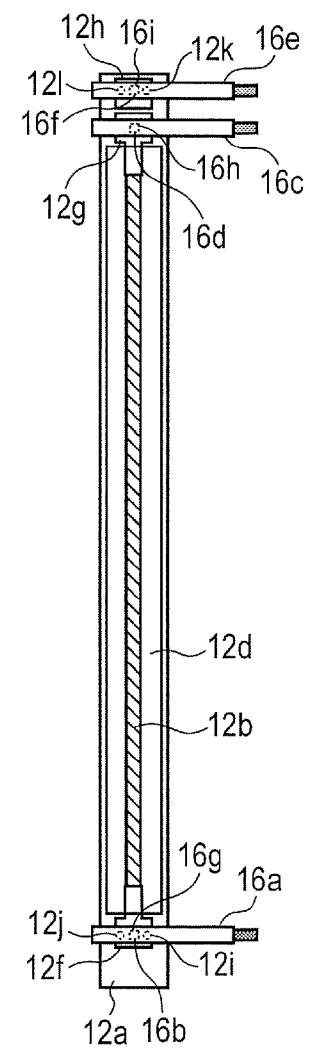
Figure 10C:
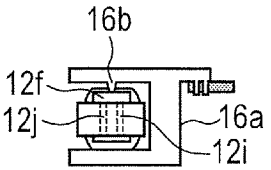
Figure 10D:
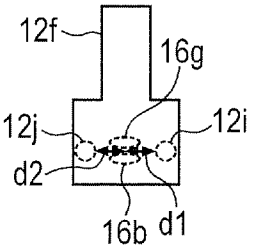
Figure 10E:
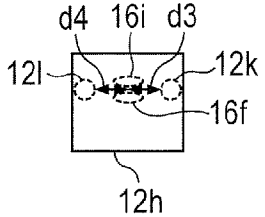
Figure 10F:
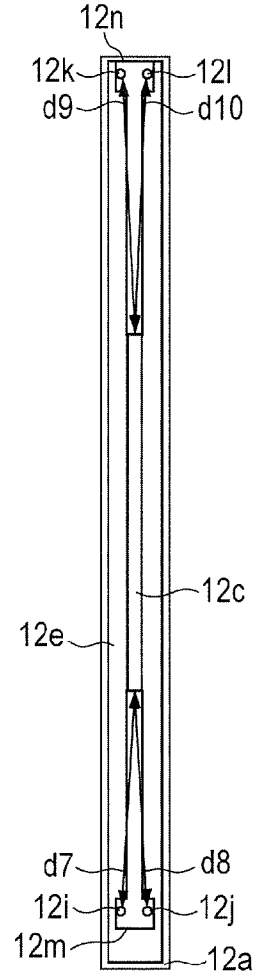

The configuration of the heater of this embodiment, the positional relationships among the through holes and the power feeding contacts, and the positional relationships among the longitudinal end portions of the heat generating resistor and the through holes are illustrated in FIGS. 10A to 10F. FIG. 10A is a view illustrating positional relationships among the through holes 12*i*, 12*j*, 12*k*, and 12*l* and the power feeding contacts 16*b*, 16*g*, 16*d*, 16*f*, and 16*i* when viewed from the downstream side of the recording material conveyance direction. FIG. 10B is a view illustrating the positional relationships among the through holes 12*i*, 12*j*, 12*k*, and 12*l* and the power feeding contacts 16*b*, 16*g*, 16*d*, 16*f*, and 16*i* when viewed from the fixing nip portion N side. In each of FIGS. 10A and 10B, the portion of the heat generating resistor which generates heat through electrification is also shown with a hatched area. FIG. 10C is a view illustrating the positional relationships among the through holes 12*i* and 12*j* and the power feeding contact 16*b* when viewed from the electrode 12*f* side. FIG. 10D is a view illustrating the positional relationships among the through holes 12*i* and 12*j* and the power feeding contacts 16*b* and 16*g* at the electrode 12*f* when viewed from the fixing nip portion N side. FIG. 10E is a view illustrating the positional relationships among the through holes 12*k* and 12*l* and the power feeding contacts 16*f* and 16*i* at the electrode 12*h* when viewed from the fixing nip portion N side. FIG. 10F is a view illustrating the positional relationships among the longitudinal end portions of the heat generating resistor 12*c* and the through holes 12*i*, 12*j*, 12*k*, and 12*l* when viewed from the side opposite to the fixing nip portion N side. In each of FIGS. 10B and 10C, a lead wire is also shown with a solid area.

In the heater 12 of this embodiment, similarly to the heater of Embodiment 3, in each of the two electrodes 12*f* and 12*h*, the positional relationships among the through holes and the power feeding contacts were set so that the shortest distances from the middle point of the two power feeding contacts to the periphery parts of the through holes were substantially equal to each other.

Further, the positional relationships among the through holes and the power feeding contacts in the two electrodes 12*f* and 12*h* were set so that the shortest distances from the middle point of the two power feeding contacts to the periphery parts of the through holes were substantially equal to each other. That is, as illustrated in FIG. 10D, when the shortest distance between the middle point of the power feeding contacts 16*b* and 16*g* and the periphery part of the through hole 12*i* was defined as d1 and the shortest distance between the middle point of the power feeding contacts 16*b* and 16*g* and the periphery part of the through hole 12*j* was defined as d2, d1 and d2 were set to be substantially equal to each other.

As illustrated in FIG. 10E, when the shortest distance between the middle point of the power feeding contacts 16*f* and 16*i* and the periphery part of the through hole 12*k* was defined as d3, and the shortest distance between the middle point of the power feeding contacts 16*f* and 16*i* and the periphery part of the through hole 12*l* was defined as d4, d3 and d4 were set to be substantially equal to each other. In this embodiment, both of d1 and d2 were set to 2 mm, and both of d3 and d4 were set to 2 mm.

As illustrated in FIG. 10F, when the shortest distance between the one longitudinal end portion of the heat generating resistor 12*c* and the through hole 12*i* was defined as d7 and the shortest distance between the one longitudinal end portion of the heat generating resistor 12*c* and the through hole 12*j* was defined as d8, both of d7 and d8 were set to 120 mm. Further, when the shortest distance between the another longitudinal end portion of the heat generating resistor 12*c* and the through hole 12*k* was defined as d9 and the shortest distance between the another longitudinal end portion of the heat generating resistor 12*c* and the through hole 12*l* was defined as d10, both of d9 and d10 were set to 130 mm.

The effects obtained by using the above-mentioned configuration were tested under conditions similar to those of Embodiment 1. The number of testing times reached 8,000 times, and the above-mentioned configuration achieved a longer life by 2,000 times than the configuration of Embodiment 3.

The heater 12 of this embodiment is configured so that the distances between the middle point of the power feeding contacts and the through holes become d1=d2 and d3=d4. Further, the heater 12 of this embodiment is configured so that the distances between the one longitudinal end portion of the heat generating resistor 12*c* and the through holes become d7=d8, and the distances between the another longitudinal end portion of the heat generating resistor 12*c* and the through holes become d9=d10. Therefore, the total distances of the power feeding paths to the heat generating resistor 12*c* when passing through the respective through holes 12*i* and 12*j* in the electrode 12*f* are substantially equal to each other. Further, the total distances of the power feeding paths to the heat generating resistor 12*c* when passing through the respective through holes 12*k* and 12*l* in the electrode 12*h* are substantially equal to each other. With this, deterioration of the through holes 12*i*, 12*j*, 12*k*, and 12*l* can be suppressed, and the reliability of the electrification of the heater 12 can be increased. Thus, also in the heater 12 of this embodiment, the burning of the through hole and the conduction failure caused by the burning can be prevented.

This testing was a mode of evaluating the reliability of the heater at an accelerated rate, and even in the heater of this embodiment, the conduction tended to be reduced. However, when the heater of this embodiment was used in the fixing apparatus of the image forming apparatus, no rise in resistance along with the deterioration of the through hole was observed in the same number of times, and there was no problem for actual use.

Although Embodiment 4 describes the heater 12 in which the number of through holes is 2 for each electrode, it is easy to presume that, even in a configuration in which the number of through holes is further increased, the reliability of the electrification of the heater can be increased.

In the heater 12 of this embodiment, even when the electrodes 12*f*, 12*g*, and 12*h* and the conductors 12*m* and 12*n* are arranged on the inner side of the one longitudinal end portion of the substrate 12*a*, similar actions and effects can be obtained. Alternatively, even when the electrodes 12*f*, 12*g*, and 12*h* and the conductors 12*m* and 12*n* are arranged on the inner side of the another longitudinal end portion of the substrate 12*a*, similar actions and effects can be obtained.

In the heater 12 of this embodiment, even when the heat generating resistor 12*b* and the electrode 12*g* are not provided, similar actions and effects can be obtained. In this case, the electrode 12*f* is not used as the common electrode, and is used as a power feeding electrode for feeding power to the heat generating resistor 12*c* from the front surface of the substrate 12*a*. The heater 12 in this case includes the substrate 12*a*, the electrodes 12*f* and 12*h*, the heat generating resistor 12*c*, the conductors 12*m* and 12*n*, and the through holes 12*i*, 12*j*, 12*k*, and 12*l*, and d1=d2, d3=d4, d7=d8, and d9=d10 are satisfied. With this, the burning of the through hole and the conduction failure caused by the burning can be prevented.

Further, in the case where the heat generating resistor 12*b* and the electrode 12*g* are not provided in the heater 12 of this embodiment, even when the heat generating resistor 12*c* is set to have the same length as the heat generating resistor 12*b*, similar actions and effects can be obtained.

Further, in the case where the heat generating resistor 12*b* and the electrode 12*g* are not provided in the heater 12 of this embodiment, even when the electrodes 12*f* and 12*h* and the conductors 12*m* and 12*n* are arranged on the inner side of the one longitudinal end portion of the substrate 12*a*, similar actions and effects can be obtained. Alternatively, even when the electrodes 12*f* and 12*h* and the conductors 12*m* and 12*n* are arranged on the inner side of the another longitudinal end portion of the substrate 12*a*, similar actions and effects can be obtained.

(Embodiment 5)

(1) Configuration of Heater (Heating Member) 12

Figure 11A:
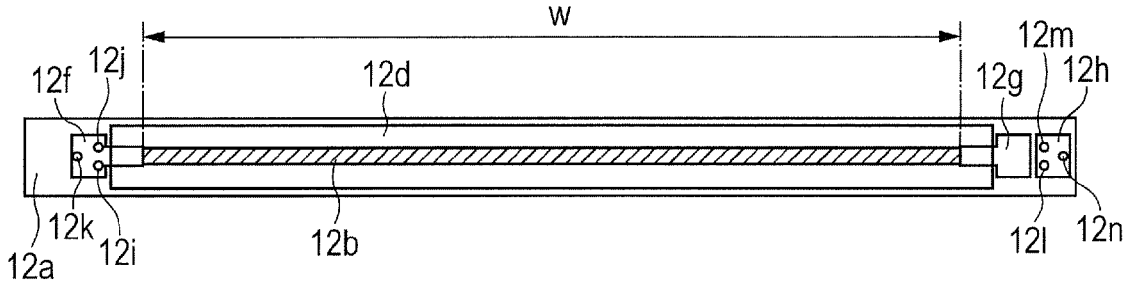
FIGS. 11A, 11B, and 11C are views illustrating a configuration of a heater according to Embodiment 5 of the present invention.
Figure 11B:
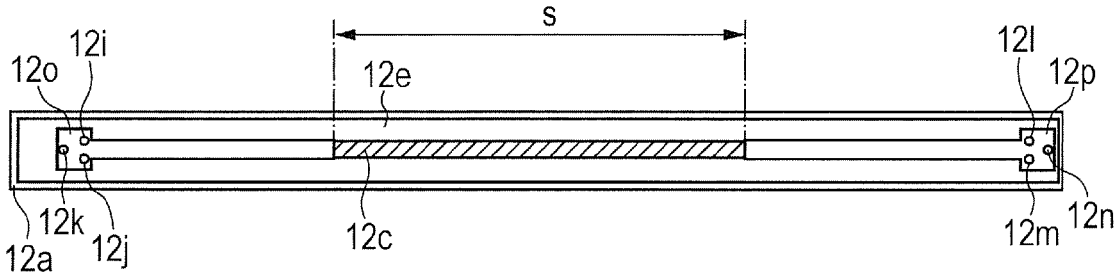
Figure 11C:
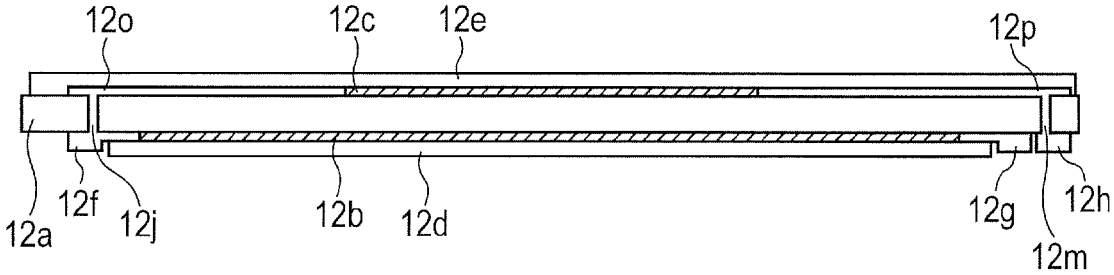

Referring to FIGS. 11A, 11B, and 11C, a configuration of a heater 12 is described. FIG. 11A is a schematic view of the configuration of the heater 12 when the heater 12 is viewed from a nip portion N side, and FIG. 11B is a schematic view of the configuration of the heater 12 when the heater 12 is viewed from a side opposite to the nip portion N side. FIG. 11C is a schematic view of a vertical sectional configuration in the longitudinal direction passing through a through hole 12*j* and a through hole 12*m* of the heater 12. The scale size in the thickness direction of the heater 12 illustrated in FIG. 11C is enlarged for the sake of description. In each of FIGS. 11A to 11*c*, the portion of the heat generating resistor which generates heat through electrification is also shown with a hatched area. The heater 12 includes an electrically insulated and elongated heater substrate (hereinafter referred to as "substrate") 12*a*.

On a front surface (second surface) of the substrate 12*a* on the nip portion N side, a heat generating resistor (first heat generating resistor) 12*b* which generates heat through electrification is provided on the substrate 12*a* along its longitudinal direction. Then, on an inner side of one longitudinal end portion of the substrate 12*a*, there is provided a power feeding electrode portion 12*f* electrically connected to one longitudinal end portion of the heat generating resistor 12*b*, and on an inner side of another longitudinal end portion of the substrate, there is provided a power feeding electrode portion 12*h* which does not physically come into contact with the another longitudinal end portion of the heat generating resistor 12*b*. On the further inner side of the another longitudinal end portion of the substrate 12*a*, there is provided a power feeding electrode portion 12*g* electrically connected to the heat generating resistor 12*b*. The power feeding electrode portion 12*g* is arranged on the longitudinal inner side of the substrate 12*a* with respect to the power feeding electrode portion 12*h*.

The power feeding electrode portion 12*f* is arranged so as to have an area opposed to a conductor 12*o* described later, and the power feeding electrode portion 12*h* is arranged so as to have an area opposed to a conductor 12*p* described later.

On the front surface of the substrate 12*a*, there is further provided an insulated surface protective layer 12*d* for covering the heat generating resistor 12*b* and connection parts of the respective power feeding electrode portions 12*f* and 12*g* with respect to the heat generating resistor 12*b*.

On a back surface (first surface) of the substrate 12*a* on the side opposite to the fixing nip portion N side, a heat generating resistor (second heat generating resistor) 12*c* which generates heat through electrification is provided on the substrate 12*a* along its longitudinal direction. The heat generating resistor 12*c* is formed shorter than the heat generating resistor 12*b* and is arranged at substantially a center of the substrate 12*a* in the longitudinal direction. Then, on the inner side of the one longitudinal end portion of the substrate 12*a*, there is provided the conductor 12*o* electrically connected to one longitudinal end portion of the heat generating resistor 12*c*, and on the inner side of the another longitudinal end portion of the substrate, there is provided the conductor 12*p* electrically connected to another longitudinal end portion of the heat generating resistor 12*c*.

Of the conductors 12*o* and 12*p* provided at both the ends of the heat generating resistor 12*c*, the conductor 12*o* is arranged so as to be opposed to the power feeding electrode portion 12*f* through intermediation of the substrate 12*a* in the thickness direction of the substrate 12*a*. The conductor 12*p* is arranged so as to be opposed to the power feeding electrode portion 12*h* through intermediation of the substrate 12*a* in the thickness direction of the substrate 12*a*.

Further, on the back surface of the substrate 12*a*, there is provided an insulated surface protective layer 12*e* for covering the heat generating resistor 12*c* and connection parts of the conductors 12*o* and 12*p* with respect to the heat generating resistor 12*c*.

Further, the power feeding electrode portion 12*f* and the conductor 12*o* are electrically connected to each other via three through holes 12*i*, 12*j*, and 12*k* passing through the substrate 12*a* in the thickness direction of the substrate 12*a*. Further, the power feeding electrode portion 12*h* and the conductor 12*p* are electrically connected to each other via three through holes 12*m*, 12*n*, and 12*l* passing through the substrate 12*a* in the thickness direction of the substrate 12*a*. Thus, the power feeding electrode portion 12*f* is used as a common electrode for the two heat generating resistors 12*b* and 12*c*, and the power feeding electrode portion 12*h* is used as a power feeding electrode for feeding power to the heat generating resistor 12*c* from the front surface of the substrate 12*a*.

The power feeding electrode portions 12*f*, 12*h*, and 12*g* are electrically connected to power feeding connectors 16*a*, 16*e*, and 16*c* (see FIGS. 12A to 12C) as power feeding members, respectively. With this, power is fed from the power feeding connectors 16*a*, 16*e*, and 16*c* to the power feeding electrode portions 12*f*, 12*h*, and 12*g*, and thus the heat generating resistors 12*b* and 12*c* generate heat.

The substrate 12*a* may be made of ceramics such as alumina and aluminum nitride. In this embodiment, an alumina substrate having a lateral width of 7 mm, a length of 280 mm, and a thickness of 1 mm was used.

The heat generating resistors 12*b* and 12*c* may be each formed by applying an electrical resistant material such as Ag/Pd, $RuO_2$, $Ta_2N$, graphite, SiC, and $LaCrO_3$ by screen printing into a linear or band pattern. Note that, Ag/Pd is silver-palladium, $RuO_2$ is ruthenium oxide, $Ta_2N$ is tantalum nitride, SiC is silicon carbide, and $LaCrO_3$ is lanthanum chromite.

In this embodiment, both of the heat generating resistors 12*b* and 12*c* were formed by screen printing of a material obtained by kneading Ag/Pd, glass powder, and an organic binder and then were subjected to baking. The heat generating resistor 12*c* was set to have a length s of 115 mm and a resistance of 30Ω. The heat generating resistor 12*b* was set to have a length w of 230 mm and a resistance of 15Ω. The heat generating resistor 12*c* was set to have a length corresponding to a small-sized recording material (recording sheet) having a small recording material width. The heat generating resistor 12*b* was set to have a length corresponding to a large-sized recording material (recording sheet) having a recording material width larger than that of the small-sized recording material.

The surface protective layers 12*d* and 12*e* are each formed for the purpose of securing insulation between the surface of the heater 12 and the heat generating resistor 12*b* or 12*c*. In this embodiment, an 80-μm insulated glass was formed by screen printing.

The power feeding electrode portions 12*f*, 12*g*, and 12*h* and the conductors 12*o* and 12*p* may be each formed by screen printing of conductive paste having silver (Ag) or platinum (Pt) as a main component. Alternatively, conductive paste having gold (Au), a silver-platinum (Ag/Pt) alloy, or a silver-palladium (Ag/Pd) alloy as a main component can be used to form the electrodes and conductors by screen printing. In this embodiment, all of the power feeding electrode portions and conductors were formed by screen printing of silver. Further, the power feeding electrode portions 12*f*, 12*g*, and 12*h* and the conductors 12*o* and 12*p* are provided for the purpose of feeding power to the heat generating resistors 12*b* and 12*c*, and hence the electrical resistances thereof were set sufficiently smaller than those of the heat generating resistors 12*b* and 12*c*.

The through holes 12*i*, 12*j*, 12*k*, 12*l*, 12*m*, and 12*n* may be formed by a method of providing through holes through the substrate 12*a* by laser processing prior to forming the power feeding electrode portions 12*f* and 12*h*. Inside those through holes, conductive paste having silver (Ag), platinum (Pt), or gold (Au) as a main component may be provided to form conductive paths. Alternatively, inside those through holes, conductive paste having a silver-platinum (Ag/Pt) alloy or a silver-palladium (Ag/Pd) alloy as a main component may be provided to form the conductive paths. In this embodiment, the through holes were formed by laser processing to have a diameter of 0.3 mm, and silver conductive paste was provided therein to form the conductive paths between the power feeding electrode portions 12*f* and 12*h* and the conductors 12*o* and 12*p*.

(2) Positional Relationships Among Through Holes of Heater and Power Feeding Contacts of Power Feeding Connectors In the heater 12 of this embodiment, the respective through holes were formed so that, when the power feeding contact was mounted, an area obtained by connecting center points of the three through holes surrounded the power feeding contact. The purpose thereof is to reduce imbalance of current amounts flowing through the respective through holes, to thereby suppress the deterioration of the through holes. As compared to the case where the power feeding contact is arranged out of an area surrounded by the through holes, the configuration of this embodiment can more reduce variations in distance between the power feeding contact and the through hole, which can lead to reduction of imbalance of flowing current amounts.

The positional relationships among the through holes and the power feeding contacts of this embodiment are described with reference to FIGS. 12A to 12E. FIGS. 12A to 12E are views illustrating the positional relationships among the through holes and the power feeding contacts when the power feeding connectors 16*a*, 16*c*, and 16*e* are connected to the heater 12.

Figure 12A:
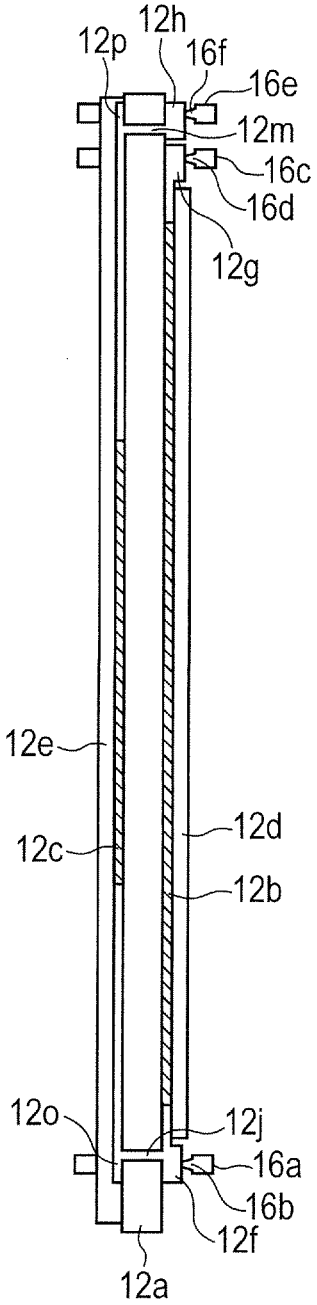
FIGS. 12A, 12B, 12C, 12D, and 12E are views illustrating positional relationships among through holes and power feeding contacts when power feeding connectors are connected to the heater according to Embodiment 5.
Figure 12B:
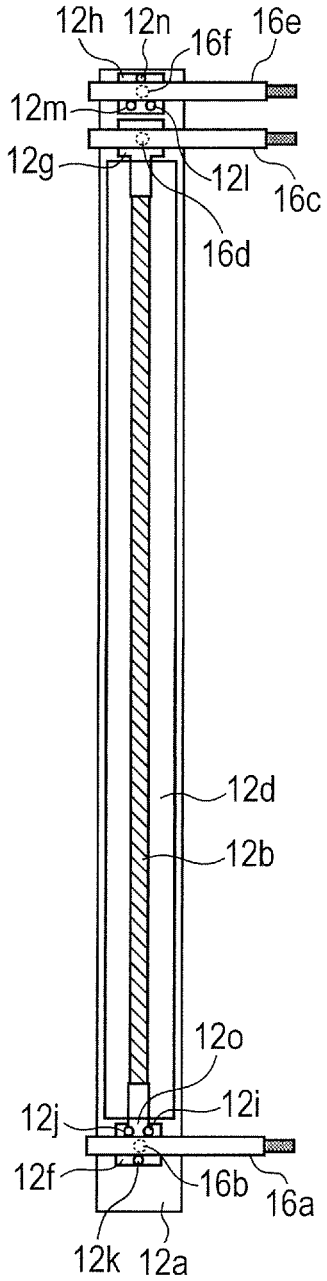
Figure 12C:
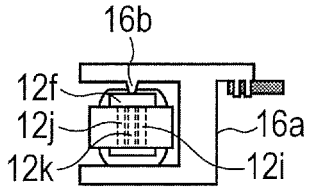
Figure 12D:
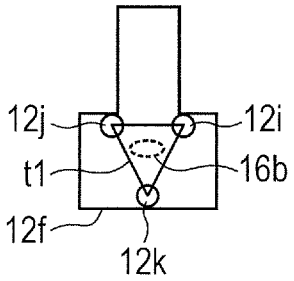
Figure 12E:
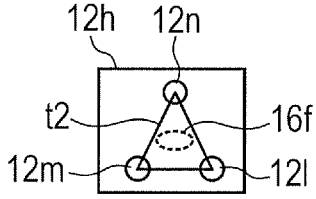

FIG. 12A is a view illustrating positional relationships among the through holes 12*i*, 12*j*, 12*k*, 12*l*, 12*m*, and 12*n* and the power feeding contacts 16*b*, 16*d*, and 16*f* when viewed from the downstream side of the recording material conveyance direction. FIG. 12B is a view illustrating the positional relationships among the through holes 12*i*, 12*j*, 12*k*, 12*l*, 12*m*, and 12*n* and the power feeding contacts 16*b*, 16*d*, and 16*f* when viewed from the nip portion N side. In each of FIGS. 12A and 12B, the portion of the heat generating resistor which generates heat through electrification is also shown with a hatched area. FIG. 12C is a view illustrating positional relationships among the through holes 12*i*, 12*j*, and 12*k* and the power feeding contact 16*b* when viewed from the power feeding electrode portion 12*f* side. FIG. 12D is a view illustrating positional relationships among the through holes 12*i*, 12*j*, and 12*k* and the power feeding contact 16*b* at the power feeding electrode portion 12*f* when viewed from the nip portion N side. FIG. 12E is a view illustrating positional relationships among the through holes 12*l*, 12*m*, and 12*n* and the power feeding contact 16*f* at the power feeding electrode portion 12*h* when viewed from the nip portion N side. The scale size in the thickness direction of the heater 12 illustrated in FIGS. 12A and 12C is enlarged for the sake of description. In each of FIGS. 12B and 12C, lead wires shown with solid areas are supported by the power feeding connectors 16*c*, 16*e*.

Referring to FIGS. 12A to 12E, the positional relationships among the power feeding contacts and the through holes are described.

The power feeding connectors 16*a*, 16*c*, and 16*e* include the power feeding contacts 16*b*, 16*d*, and 16*f* for forming electrical conduction while being brought into press contact with the power feeding electrode portions 12*f*, 12*g*, and 12*h* of the heater 12, respectively. In this embodiment, the power feeding connectors 16*a*, 16*c*, and 16*e* were each inserted to the heater 12 supported by the film guide 14 from the right direction in FIG. 12B, that is, the upstream side of the recording material conveyance direction, and the film guide 14 (not shown) was used for positioning and preventing the power feeding connectors from slipping out. With this, the positions of the power feeding contacts 16*b*, 16*d*, and 16*f* were determined with respect to the power feeding electrode portions 12*f*, 12*g*, and 12*h* on the heater 12. With this configuration, positional relationships among the power feeding contacts 16*b* and 16*f* and the through holes 12*i*, 12*j*, 12*k*, 12*l*, 12*m*, and 12*n* were determined.

As illustrated in FIG. 12D, when the area formed by connecting the center points of the respective through holes 12*i*, 12*j*, and 12*k* was defined as t1, the power feeding contact 16*b* was arranged within the area t1. Similarly, as illustrated in FIG. 12E, when the area formed by connecting the center points of the respective through holes 12*l*, 12*m*, and 12*n* was defined as t2, the power feeding contact 16*f* was arranged within the area t2.

Next, in order to confirm the effects obtained through use of the above-mentioned configuration, the reliability of the electrification of the heater 12 was tested. The test was performed under the following conditions. Under a state in which the heater 12 was incorporated in the fixing apparatus 1, the heater 12 was connected to a 100 V power source and an electrification control section. Then, similarly to Embodiment 1, electrification and non-electrification were repeated based on the detection results of the temperature detection element 15 through temperature control in which the temperature target as shown in FIG. 4 was set as one cycle of 60 seconds. The reliability was evaluated based on the number of times of the testing cycles when the resistance of the through hole increased and the conduction reduced.

Figure 13A:
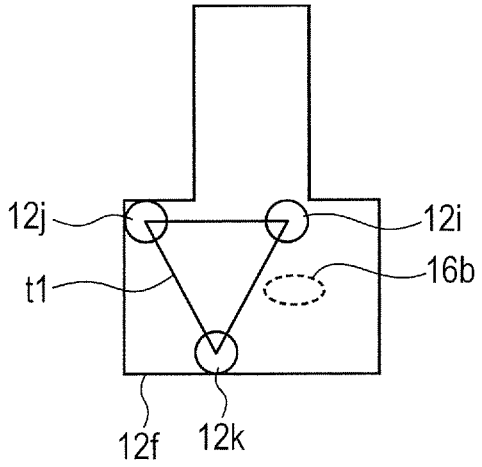
FIGS. 13A and 13B are views illustrating positions of through holes on a power feeding electrode portion of a heater according to a comparative example with respect to Embodiment 5.
Figure 13B:
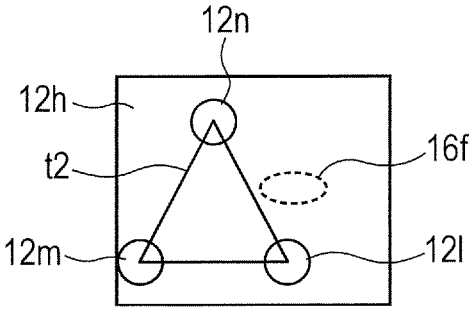

Further, as a comparative example, a heater having such a configuration that the positional relationships among the through holes 12*i*, 12*j*, and 12*k* and the power feeding contact 16*b*, and the positional relationships among the through holes 12*l*, 12*m*, and 12*n* and the power feeding contact 16*f* were set as illustrated in FIGS. 13A and 13B was similarly subjected to the testing. The heater of the comparative example was configured so that, while maintaining the same shape of the through holes 12*i*, 12*j*, 12*k*, 12*l*, 12*m*, and 12*n* and the same intervals of the through holes, the positional relationships with respect to the power feeding contacts 16*b* and 16*f* were shifted so that the power feeding contacts 16*b* and 16*f* were not included in the areas t1 and t2, respectively.

A difference in distances between the power feeding contact 16*b* and the center of the closest one of the through holes within the power feeding electrode portion 12*f* and between the power feeding contact 16*b* and the center of the farthest one of the through holes was set to 0.3 mm in the heater 12 of this embodiment, and to 1.1 mm in the heater of the comparative example. Further, a difference in distances between the power feeding contact 16*f* and the center of the closest one of the through holes within the power feeding electrode portion 12*h* and between the power feeding contact 16*f* and the center of the farthest one of the through holes was set to 0.3 mm in the heater 12 of this embodiment, and to 1.1 mm in the heater of the comparative example.

Respective evaluation results are shown in Table 4.

TABLE 4

| Difference of electrification performance depending on through hole positions | |
|---|---|
| Positions of power feeding contacts 16b and 16f | Number of testing times |
| Positions included in t1 and t2 | 7,800 times |
| Positions not included in t1 and t2 | 4,200 times |

As shown in Table 4, the configuration of this embodiment in which the power feeding contact 16*b* was included in the area t1 and the power feeding contact 16*f* was included in the area t2 achieved 1.9 times longer life than the configuration in which the power feeding contacts were not included in the respective areas. Therefore, it was possible to increase the reliability of the electrification of the heater using the through holes of this embodiment.

In this evaluation, in the configuration of the comparative example in which both of the power feeding contacts 16*b* and 16*f* were not included in the areas t1 and t2, respectively, such a tendency was observed that the through hole having a smaller distance first deteriorated and the resistance thereof increased, and immediately after that, the through hole having a larger distance also deteriorated due to current concentration. In contrast, in the configuration of this embodiment in which the power feeding contact 16*b* was included in the area t1 and the power feeding contact 16*f* was included in the area t2, the currents flowed in a well-balanced manner, and hence it was possible to increase the number of times taken until deterioration, and it was confirmed that the intended effects were obtained. Therefore, in the heater 12 of this embodiment, the burning of the through holes 12*i*, 12*j*, 12*k*, 12*l*, 12*m*, and 12*n* and the conduction failure caused by the burning can be prevented.

This testing was a mode of evaluating the reliability of the heater at an accelerated rate, and even in the heater 12 of this embodiment, the conduction tended to be reduced. However, when the heater 12 of this embodiment was used in the fixing apparatus of the image forming apparatus, no rise in resistance along with the deterioration of the through holes 12*i*, 12*j*, 12*k*, 12*l*, 12*m*, and 12*n* was observed in the same number of times, and there was no problem for actual use.

(Embodiment 6)

Another embodiment of the heater is described. The heater 12 of Embodiment 5 illustrated in FIGS. 11A to 11C and 12A to 12E adopted a configuration in which the heat generating resistors 12*b* and 12*c* were provided on both surfaces (front surface and back surface) of the substrate 12*a* for the purpose of preventing temperature rise of the non-paper passing portion of the small-sized paper. In contrast to this configuration, description is next made of a configuration in which a heat generating resistor 12*s* is provided only on one surface (front surface or back surface) of the substrate 12*a* so as to describe that actions and effects similar to those of Embodiment 1 can be obtained even in this configuration.

Figure 14A:
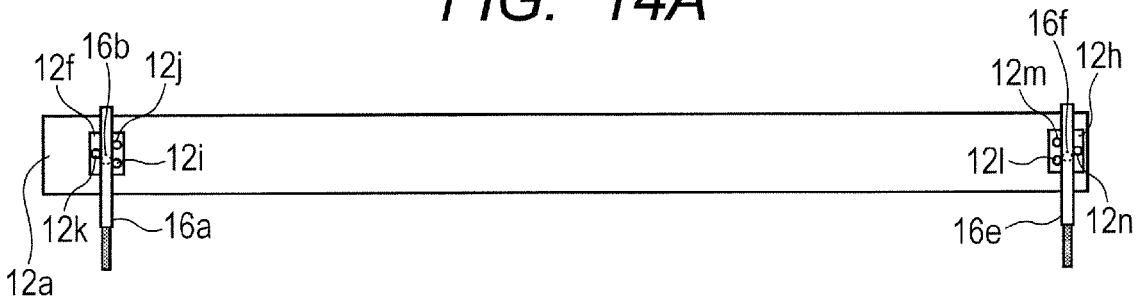
FIGS. 14A, 14B, 14C, and 14D are views illustrating a configuration of a heater according to Embodiment 6 of the present invention.
Figure 14B:
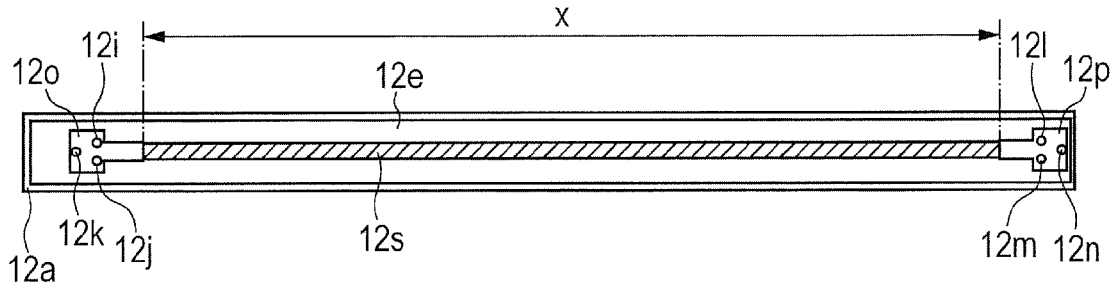
Figure 14C:
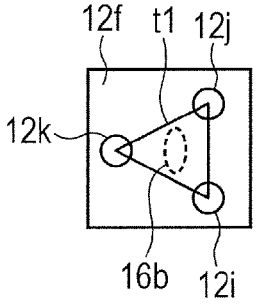
Figure 14D:
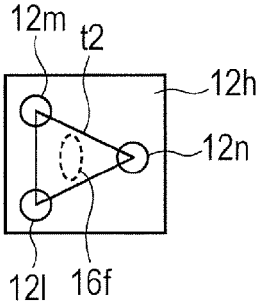

The configuration of the heater 12 in the case where the heat generating resistor 12*s* is provided only on one surface of the substrate 12*a*, and the positional relationships among the through holes 12*i*, 12*j*, 12*k*, 12*l*, 12*m*, and 12*n* and the power feeding contacts 16*b* and 16*f* are illustrated in FIGS. 14A to 14D. FIG. 14A is a schematic view of the configuration of the heater when viewed from the front surface side of the substrate 12*a*, and FIG. 14B is a schematic view of the configuration of the heater when viewed from the back surface side of the substrate 12*a*. FIG. 14C is an enlarged view of a part of the power feeding electrode portion 12*f* of FIG. 14A, and FIG. 14D is an enlarged view of a part of the power feeding electrode portion 12*h* of FIG. 14A. In each of FIGS. 14A and 14B, the portion of the heat generating resistor which generates heat through electrification is also shown with a hatched area, while a lead wire is also shown with a solid area.

In the case of the heater 12 of this configuration, the power feeding electrode portion 12*f* is not used as the common electrode, but is used as a power feeding electrode for feeding power to the heat generating resistor 12*s* from the front surface side of the substrate 12*a*. Further, the heat generating resistor 12*s* was set to have a length x of 230 mm, which was a length corresponding to the large-sized recording material (recording sheet) having a larger recording material width than the small-sized recording material, and to have a resistance of 15 Ω.

The heater 12 in this case includes the substrate 12*a*, the power feeding electrode portions 12*f* and 12*h*, the heat generating resistor 12*s*, the conductors 12*o* and 12*p*, the through holes 12*i*, 12*j*, 12*k*, 12*l*, 12*m*, and 12*n*, and the surface protective layer 12*e*.

The heat generating resistor 12*s* is provided on the back surface of the substrate 12*a* along the longitudinal direction of the substrate 12*a*. The conductors 12*o* and 12*p* are provided on the back surface of the substrate 12*a* at both ends of the heat generating resistor 12*s*. The surface protective layer 12*e* is provided on the back surface of the substrate 12*a*, and covers the heat generating resistor 12*s* and connection parts of the respective conductors 12*o* and 12*p* with respect to the heat generating resistor 12*s*. Further, the power feeding contact 16*b* is included in the area t1, and the power feeding contact 16*f* is included in the area t2. With this, the burning of the through holes 12*i*, 12*j*, 12*k*, 12*l*, 12*m*, and 12*n* and the conduction failure caused by the burning can be prevented.

Further, even in a configuration in which the power feeding contacts 16*b* and 16*f* are provided on the back surface of the substrate 12*a* due to limitations of space for connection of the power feeding connectors 16*a* and 16*e*, actions and effects similar to those of this embodiment can be obtained. That is, the heat generating resistor 12*s* and the conductors 12*o* and 12*p* are provided on the front surface of the substrate 12*a*, the power feeding electrode portions 12*f* and 12*h* are provided on the back surface of the substrate 12*a*, and power is fed to the heat generating resistor 12*s* from the back surface side of the substrate 12*a* across the substrate 12*a*. In the case of the heater 12 having this configuration, the front surface of the substrate 12*a* is set as the first surface.

The heater 12 in this case is also configured so that the power feeding contact 16*b* is included in the area t1 and the power feeding contact 16*f* is included in the area t2. Thus, the burning of the through holes 12*i*, 12*j*, 12*k*, 12*l*, 12*m*, and 12*n* and the conduction failure caused by the burning can be prevented.

(Embodiment 7)

Another embodiment of the heater is described. The heater 12 illustrated in FIGS. 11A to 11C and 12A to 12E was configured so that the power feeding electrode portions 12*f* and 12*h* each having three through holes were provided on the inner side of both the end portions of the substrate 12*a*. In contrast to this configuration, description is next made of a case where the positions of the power feeding electrode portions 12*f* and 12*h* are changed so as to describe that similar actions and effects can be obtained even in this case.

Figure 15A:
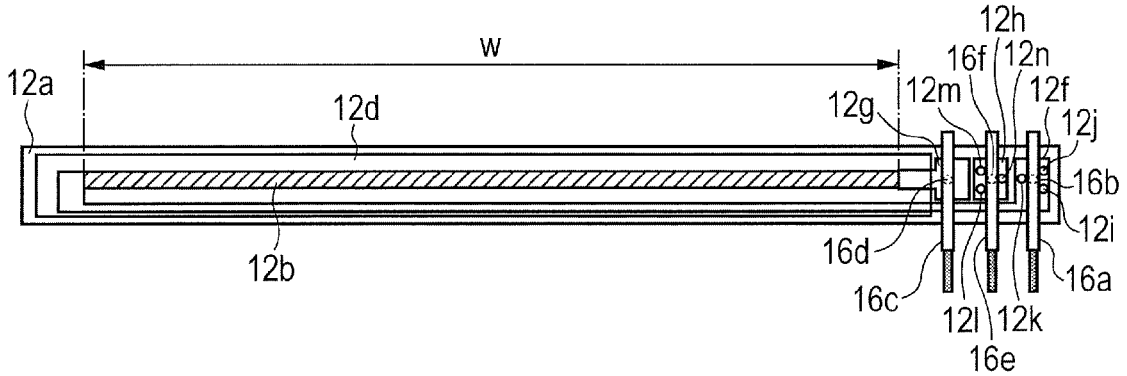
FIGS. 15A, 15B, 15C, and 15D are views illustrating a configuration of a heater according to Embodiment 7 of the present invention.
Figure 15B:
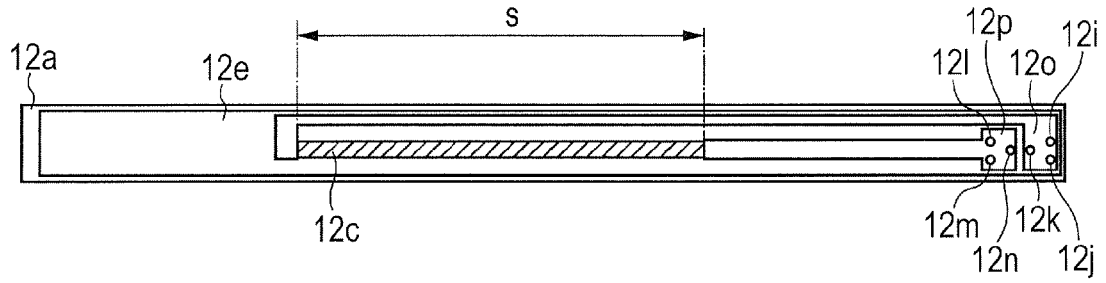
Figure 15C:
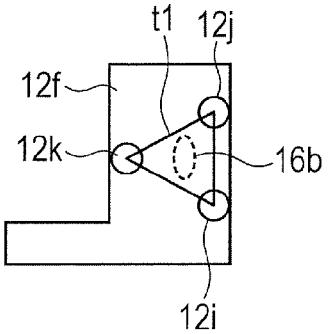
Figure 15D:
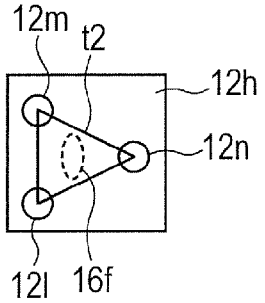

The configuration of the heater 12 in the case where the power feeding contacts 16*b* and 16*f* are collected at one end of the substrate 12*a*, and the positional relationships among the through holes 12*i*, 12*j*, 12*k*, 12*l*, 12*m*, and 12*n* and the power feeding contacts 16*b* and 16*f* are illustrated in FIGS. 15A to 15D. FIG. 15A is a schematic view of the configuration of the heater when viewed from the front surface side of the substrate 12*a*, and FIG. 15B is a schematic view of the configuration of the heater when viewed from the back surface side of the substrate 12*a*. FIG. 15C is an enlarged view of a part of the power feeding electrode portion 12*f* of FIG. 15A, and FIG. 15D is an enlarged view of a part of the power feeding electrode portion 12*h* of FIG. 15A. In each of FIGS. 15A and 15B, the portions of the heat generating resistors 12*b*, 12*c* which generate heat through electrification are shown with hatched areas. In the case of the heater 12 of this embodiment, the power feeding electrode portion 12*f* and the conductor 12*o* are provided at an end portion of the substrate 12*a* on a side opposite in the longitudinal direction to that in the configuration illustrated in FIGS. 12A to 12E. The heater in this case is also configured so that the power feeding contact 16*b* is included in the area t1 and the power feeding contact 16*f* is included in the area t2. In FIG. 15A, lead wires shown with solid areas are supported by the power feeding connectors 16*a*, 16*c* and 16*e*.

Thus, the burning of the through holes 12*i*, 12*j*, 12*k*, 12*l*, 12*m*, and 12*n* and the conduction failure caused by the burning can be prevented. That is, the actions and effects of the heater 12 of this embodiment are not limited to the positions of the power feeding contacts 16*b* and 16*f*.

(Embodiment 8)

Figure 16A:
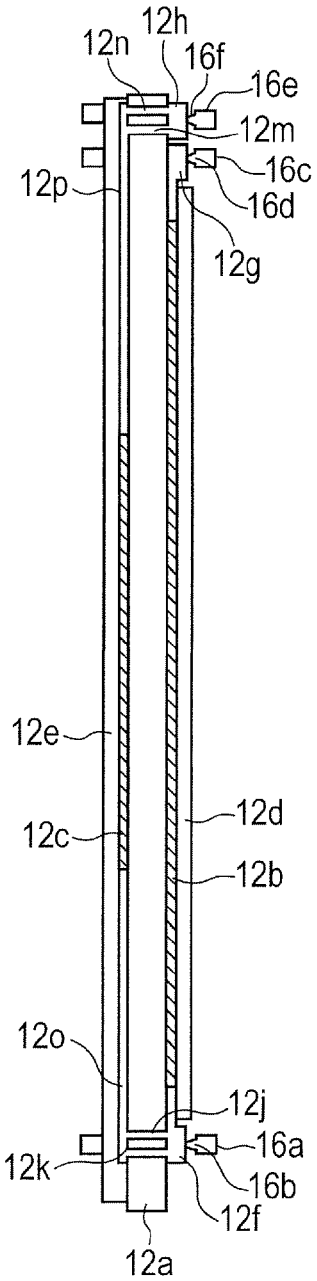
FIGS. 16A, 16B, 16C, 16D, and 16E are views illustrating positional relationships among through holes and power feeding contacts when power feeding connectors are connected to a heater according to Embodiment 8 of the present invention.
Figure 16B:
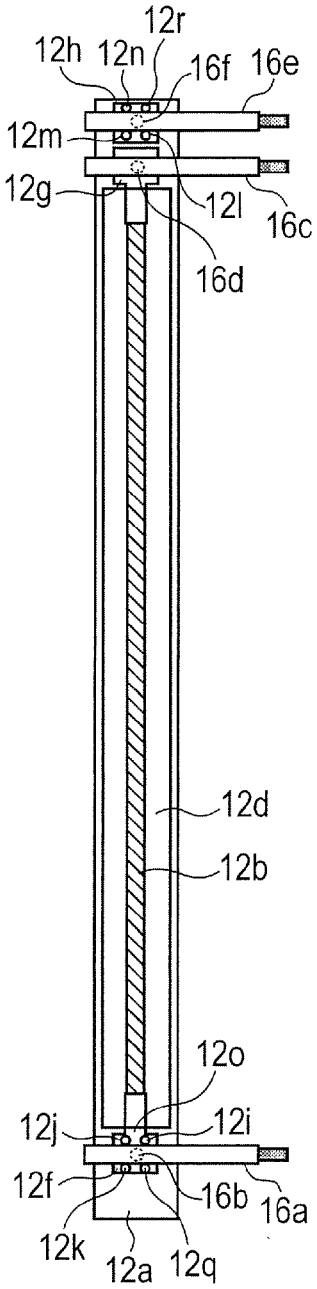

Another embodiment of the heater is described. The heater of this embodiment is intended to increase the reliability of the electrification by increasing the number of through holes per one power feeding electrode portion. As illustrated in FIGS. 16A and 16B, the power feeding electrode portion 12*f* and the conductor 12*o* are electrically connected to each other through four through holes 12*i*, 12*j*, 12*k*, and 12*q* passing through the substrate 12*a* in the thickness direction of the substrate 12*a*. Similarly, the power feeding electrode portion 12*h* and the conductor 12*p* are electrically connected to each other through four through holes 12*l*, 12*m*, 12*n*, and 12*r* passing through the substrate 12*a* in the thickness direction of the substrate 12*a*. The heater of this embodiment has the same configuration as the heater 12 of Embodiment 1 except for those points.

The configuration of the heater of this embodiment and the positional relationships among the through holes and the power feeding contacts are illustrated in FIGS. 16A to 16E. FIG. 16A is a view illustrating positional relationships among the through holes 12*i*, 12*j*, 12*k*, 12*q*, 12*l*, 12*m*, 12*n*, and 12*r* and the power feeding contacts 16*b*, 16*d*, and 16*f* when viewed from the downstream side of the recording material conveyance direction. FIG. 16B is a view illustrating the positional relationships among the through holes 12*i*, 12*j*, 12*k*, 12*q*, 12*l*, 12*m*, 12*n*, and 12*r* and the power feeding contacts 16*b*, 16*d*, and 16*f* when viewed from the nip portion N side. In each of FIGS. 16A and 16B, the portion of the heat generating resistor which generates heat through electrification is also shown with a hatched area.

Figure 16C:
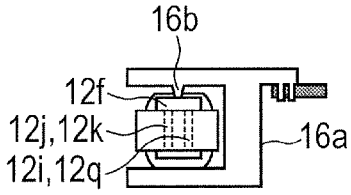
Figure 16D:
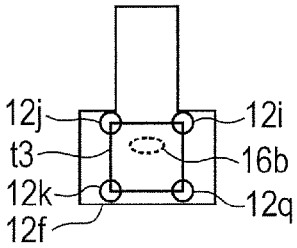
Figure 16E:
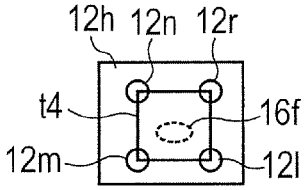

FIG. 16C is a view illustrating the positional relationships among the through holes 12*i*, 12*j*, 12*k*, and 12*q* and the power feeding contact 16*b* when viewed from the power feeding electrode portion 12*f* side. FIG. 16D is a view illustrating the positional relationships among the through holes 12*i*, 12*j*, 12*k*, and 12*q* and the power feeding contact 16*b* at the power feeding electrode portion 12*f* when viewed from the nip portion N side. FIG. 16E is a view illustrating the positional relationships among the through holes 12*l*, 12*m*, 12*n*, and 12*r* and the power feeding contact 16*f* at the power feeding electrode portion 12*h* when viewed from the nip portion N side. In each of FIGS. 16B and 16C, lead wires are shown with solid areas. The scale size in the thickness direction of the heater 12 illustrated in FIGS. 16A and 16C is enlarged for the sake of description.

In this embodiment, the through holes 12*q* and 12*r* are added to the heater of Embodiment 1. As illustrated in FIG. 16D, when an area formed by connecting the center points of the through holes 12*i*, 12*j*, 12*k*, and 12*q* was defined as t3, the power feeding contact 16*b* was arranged within the area t3. Similarly, as illustrated in FIG. 16E, when an area formed by connecting the center points of the through holes 12*l*, 12*m*, 12*n*, and 12*r* was defined as t4, the power feeding contact 16*f* was arranged within the area t4.

Figure 17A:
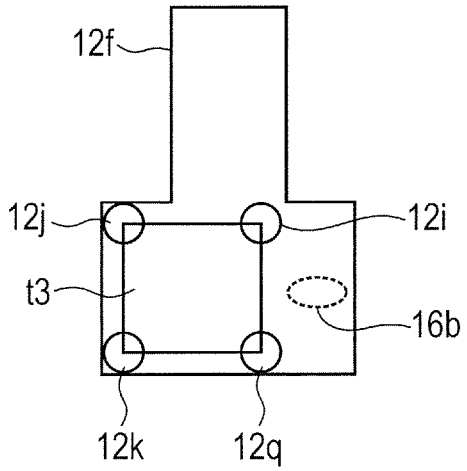
FIGS. 17A and 17B are views illustrating positions of through holes on a power feeding electrode portion of a heater according to a comparative example with respect to Embodiment 8.
Figure 17B:
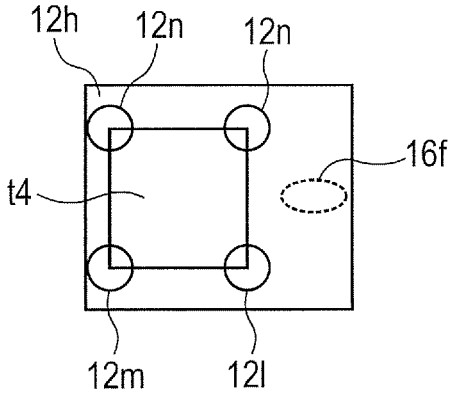

In order to confirm the effects obtained by using the above-mentioned configuration, reliability of electrification of the heater 12 was tested under conditions similar to those of Embodiment 1. Further, as a comparative example, a heater having such a configuration that, while maintaining the same shape and intervals of the through holes, the positional relationships with respect to the power feeding contacts 16*b* and 16*f* were shifted so that the power feeding contacts 16*b* and 16*f* were not included in the areas t3 and t4, respectively, as illustrated in FIGS. 17A and 17B was similarly subjected to the testing.

A difference in distances between the power feeding contact 16*b* and the center of the closest one of through holes within the power feeding electrode portion 12*f* and between the power feeding contact 16*b* and the center of the farthest one of the through holes was set to 0.2 mm in the heater 12 of this embodiment. The difference in distances was set to 1.3 mm in the heater of the comparative example. Further, a difference in distances between the power feeding contact 16*f* and the center of the closest one of the through holes within the electrode 12*h* and between the power feeding contact 16*f* and the center of the farthest one of the through holes was set to 0.2 mm in the heater 12 of this embodiment, and to 1.3 mm in the heater of the comparative example.

Respective evaluation results are shown in Table 5.

TABLE 5

| Difference of electrification performance depending on through hole positions | |
|---|---|
| Positions of power feeding contacts 16b and 16f | Number of testing times |
| Positions included in t3 and t4 | 8,200 times |
| Positions not included in t3 and t4 | 5,100 times |

As shown in Table 5, the configuration of this embodiment in which the power feeding contact 16*b* was included in the area t3 and the power feeding contact 16*f* was included in the area t4 achieved 1.6 times longer life than the configuration in which the power feeding contacts were not included in the respective areas. Therefore, it was possible to increase the reliability of the electrification of the heater using the through holes of this embodiment.

In this evaluation, in the configuration of the comparative example in which both of the power feeding contacts 16*b* and 16*f* were not included in the areas t3 and t4, respectively, such a tendency was observed that the through hole having a smaller distance first deteriorated and the resistance thereof increased, and immediately after that, the through hole having a larger distance also deteriorated due to current concentration. In contrast, in the configuration of this embodiment in which the power feeding contact 16*b* was included in the area t3 and the power feeding contact 16*f* was included in the area t4, the currents flowed in a well-balanced manner, and hence it was possible to increase the number of times taken until deterioration, and it was confirmed that the intended effects were obtained. Therefore, in the heater 12 of this embodiment, the burning of the through holes 12*i*, 12*j*, 12*k*, 12*q*, 12*l*, 12*m*, 12*n*, and 12*r* and the conduction failure caused by the burning can be prevented.

This testing was a mode of evaluating the reliability of the heater at an accelerated rate, and even in the heater 12 of this embodiment, the conduction tended to be reduced. However, when the heater 12 of this embodiment was used in the fixing apparatus of the image forming apparatus, no rise in resistance along with the deterioration of the through holes 12*i*, 12*j*, 12*k*, 12*q*, 12*l*, 12*m*, 12*n*, and 12*r* was observed in the same number of times, and there was no problem for actual use.

Further, as compared to the heater 12 of Embodiment 5, the heater 12 of this embodiment achieved a longer life by 400 times in the number of testing times, and such an effect was confirmed that, by increasing the number of through holes, the reliability was increased. That is, although the number of through holes in Embodiment 5 was 3 and the number of through holes in this embodiment was 4, it is easy to presume that, even in a configuration in which the number of through holes is further increased, the reliability of the electrification of the heater can be increased.

Also in the heater 12 of this embodiment, even in a case where, similarly to Embodiment 6, the heat generating resistor 12*c* is formed only on one surface of the substrate 12*a*, that is, the heat generating resistor 12*b* and the power feeding electrode portion 12*g* are not provided, similar actions and effects can be obtained.

The heater 12 in this case includes the substrate 12*a*, the power feeding electrode portions 12*f* and 12*h*, the heat generating resistor 12*c*, the conductors 12*o* and 12*p*, and the through holes 12*i*, 12*j*, 12*k*, 12*l*, 12*m*, 12*n*, 12*q*, and 12*r*. Further, the power feeding contact 16*b* is included in the area t3, and the power feeding contact 16*f* is included in the area t4. With this configuration, the burning of the through holes 12*i*, 12*j*, 12*k*, 12*l*, 12*m*, 12*n*, 12*q*, and 12*r* and the conduction failure caused by the burning can be prevented.

Also in the heater 12 of this embodiment, even in a case where, similarly to Embodiment 7, the positions of the power feeding electrode portions 12*f* and 12*h* are changed, similar actions and effects can be obtained. Also in this case, the power feeding contact 16*b* is included in the area t3 and the power feeding contact 16*f* is included in the area t4. With this configuration, the burning of the through holes 12*i*, 12*j*, 12*k*, 12*l*, 12*m*, 12*n*, 12*q*, and 12*r* and the conduction failure caused by the burning can be prevented.

(Embodiment 9)

Another embodiment of the heater is described. In the heater of this embodiment, two power feeding contacts are brought into contact with each of the electrodes 12*f*, 12*g*, and 12*h*. The heater of this embodiment has the same configuration as the heater 12 of Embodiment 1 except for this point.

Figure 18A:
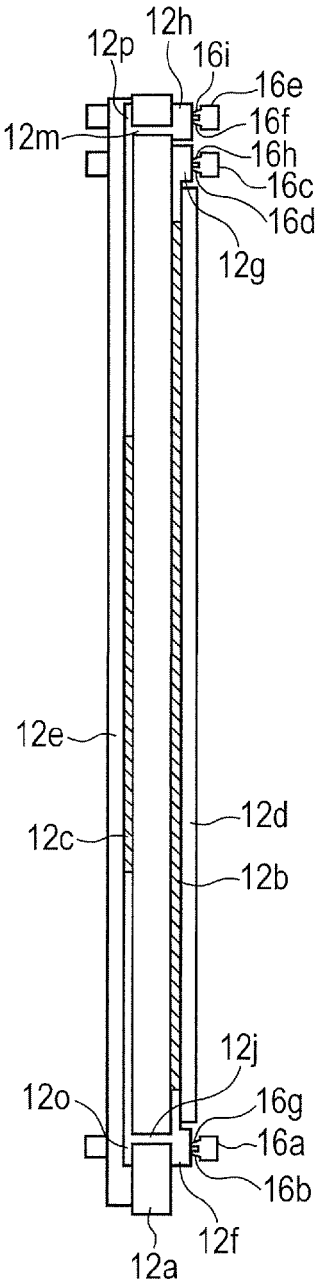
FIGS. 18A, 18B, 18C, 18D, and 18E are views illustrating positional relationships among through holes and power feeding contacts when power feeding connectors are connected to a heater according to Embodiment 9 of the present invention.
Figure 18B:
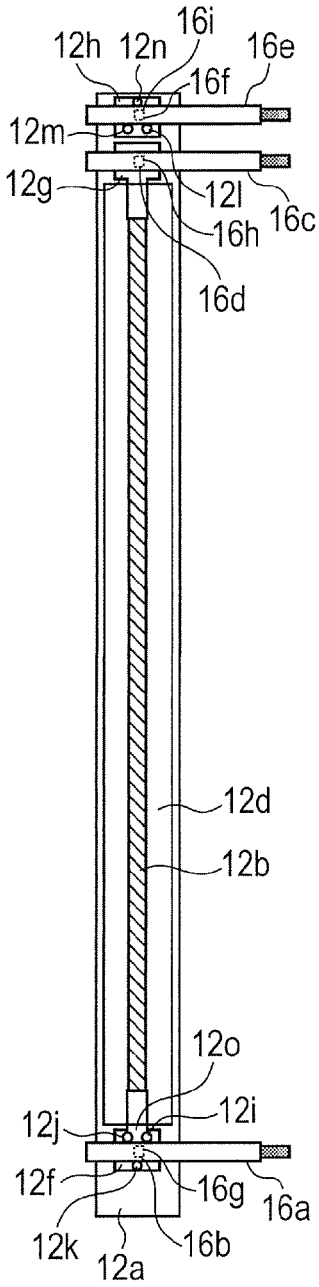

The configuration of the heater of this embodiment and the positional relationships among the through holes and the power feeding contacts are illustrated in FIGS. 18A to 18E. FIG. 18A is a view illustrating positional relationships among the through holes 12*i*, 12*j*, 12*k*, 12*l*, 12*m*, and 12*n* and power feeding contacts 16*b*, 16*g*, 16*d*, 16*h*, 16*f*, and 16*i* when viewed from the downstream side of the recording material conveyance direction. FIG. 18B is a view illustrating the positional relationships among the through holes 12*i*, 12*j*, 12*k*, 12*l*, 12*m*, and 12*n* and the power feeding contacts 16*b*, 16*g*, 16*d*, 16*h*, 16*f*, and 16*i* when viewed from the nip portion N side. In each of FIGS. 18A and 18B, the portion of the heat generating resistor which generates heat through electrification is also shown with a hatched area.

Figure 18C:
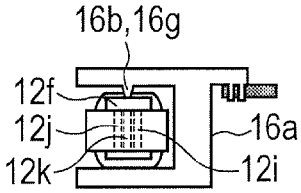
Figure 18D:
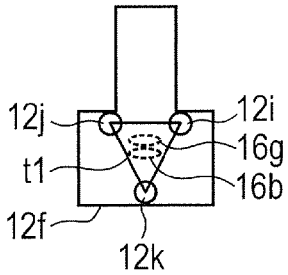
Figure 18E:
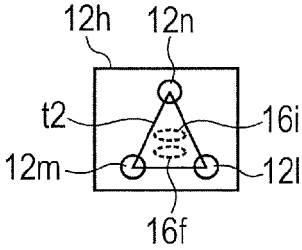

FIG. 18C is a view illustrating the positional relationships among the through holes 12*i*, 12*j*, and 12*k* and the power feeding contacts 16*b* and 16*g* when viewed from the power feeding electrode portion 12*f* side. FIG. 18D is a view illustrating the positional relationships among the through holes 12*i*, 12*j*, and 12*k* and the power feeding contacts 16*b* and 16*g* at the power feeding electrode portion 12*f* when viewed from the nip portion N side. FIG. 18E is a view illustrating the positional relationships among the through holes 12*l*, 12*m*, and 12*n* and the power feeding contacts 16*f* and 16*i* at the power feeding electrode portion 12*h* when viewed from the nip portion N side. The scale size in the thickness direction of the heater 12 illustrated in FIGS. 18A and 18C is enlarged for the sake of description.

In the heater 12 of this embodiment, the power feeding contacts 16*g*, 16*h*, and 16*i* were added to the power feeding connectors 16*a*, 16*c*, and 16*e* in the configuration of the heater 12 of Embodiment 1. In each of FIGS. 18B and 18C, lead wires shown with solid areas are supported by the power feeding connectors 16*c*, 16*e*.

With this, two power feeding contacts (multiple power feeding contacts) 16*b* and 16*g* of the power feeding connector 16*a* are electrically connected to the power feeding electrode portion 12*f* within the area of the power feeding electrode portion 12*f*. On the other hand, two power feeding contacts (multiple power feeding contacts) 16*d* and 16*h* of the power feeding connector 16*c* are electrically connected to the power feeding electrode portion 12*g* within the area of the power feeding electrode portion 12*g*. Similarly, two power feeding contacts (multiple power feeding contacts) 16*f* and 16*i* of the power feeding connector 16*e* are electrically connected to the power feeding electrode portion 12*h* within the area of the power feeding electrode portion 12*h*. In this configuration, the number of power feeding contacts present in one power feeding electrode portion is increased, and thus reliability of conduction performance is intended to be increased with respect to fluctuations in abutment degree on the power feeding electrode portion and in power feeding performance of each power feeding contact.

The positional relationships among the through holes and the power feeding contacts in the two power feeding electrode portions 12*f* and 12*h* in which the through holes were present were set so that the two power feeding contacts were included in an area formed by connecting the center points of the through holes. As illustrated in FIG. 18D, when the area formed by connecting the center points of the respective through holes 12*i*, 12*j*, and 12*k* was defined as t1, the power feeding contacts 16*b* and 16*g* were arranged within the area t1. Similarly, as illustrated in FIG. 18E, when the area formed by connecting the center points of the respective through holes 12*l*, 12*m*, and 12*n* was defined as t2, the power feeding contacts 16*f* and 16*i* were arranged within the area t2.

Figure 19A:
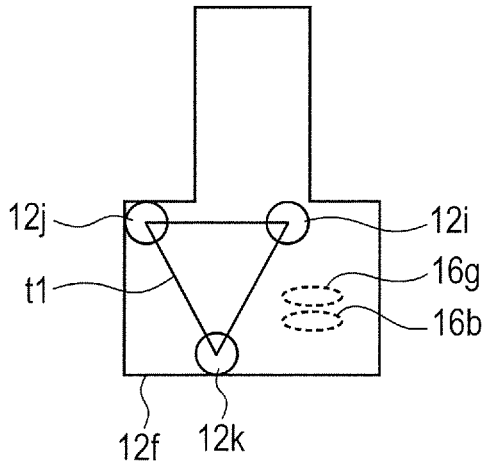
FIGS. 19A and 19B are views illustrating positions of through holes on a power feeding electrode portion of a heater according to a comparative example with respect to Embodiment 9.
Figure 19B:
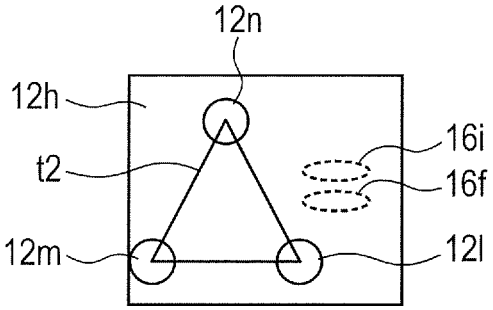

In order to confirm the effects obtained by using the above-mentioned configuration, reliability of electrification of the heater 12 was tested under conditions similar to those of Embodiment 1. Further, as a comparative example, a heater having such a configuration that the positional relationships among the through holes 12*i*, 12*j*, and 12*k* and the power feeding contact 16*b*, and the positional relationships among the through holes 12*l*, 12*m*, and 12*n* and the power feeding contact 16*f* were set as illustrated in FIGS. 19A and 19B was similarly subjected to the testing.

The heater of the comparative example was configured so as to maintain the same shape of the through holes 12*i*, 12*j*, 12*k*, 12*l*, 12*m*, and 12*n* and the same intervals of the through holes. Further, as illustrated in FIG. 19A, the positional relationships among the through holes 12*i*, 12*j*, and 12*k* and the power feeding contacts 16*b* and 16*g* were shifted so that the power feeding contacts 16*b* and 16*g* were not included in the area t1. Further, as illustrated in FIG. 19B, the positional relationships among the through holes 12*l*, 12*m*, and 12*n* and the power feeding contacts 16*f* and 16*i* were shifted so that the power feeding contacts 16*f* and 16*i* were not included in the area t2.

Respective evaluation results are shown in Table 6.

TABLE 6

| Difference of electrification performance depending on through hole positions | |
|---|---|
| Positions of power feeding contacts 16b, 16g, 16f, and 16i | Number of testing times |
| Positions included in t1 and t2 | 7,950 times |
| Positions not included in t1 and t2 | 4,280 times |

As shown in Table 6, the configuration of this embodiment in which the power feeding contacts 16*b* and 16*g* were included in the area t1 and the power feeding contacts 16*f* and 16*i* were included in the area t2 achieved 1.9 times longer life than the configuration in which the power feeding contacts were not included in the respective areas. Therefore, it was possible to increase the reliability of the electrification of the heater using the through holes of this embodiment.

In this evaluation, in the configuration of the comparative example in which both of the power feeding contacts 16*b* and 16*g* and both of the power feeding contacts 16*f* and 16*i* were not included in the areas t1 and t2, respectively, the following tendency was observed. That is, the through hole having a smaller distance first deteriorated and the resistance thereof increased, and immediately after that, the through hole having a larger distance also deteriorated due to current concentration. In contrast, in the configuration of this embodiment in which the power feeding contacts 16*b* and 16*g* were included in the area t1 and the power feeding contacts 16*f* and 16*i* were included in the area t2, the currents flowed in a well-balanced manner, and hence it was possible to increase the number of times taken until deterioration, and it was confirmed that the intended effects were obtained. Therefore, in the heater 12 of this embodiment, the burning of the through holes 12*i*, 12*j*, 12*k*, 12*l*, 12*m*, and 12*n* and the conduction failure caused by the burning can be prevented.

This testing was a mode of evaluating the reliability of the heater at an accelerated rate, and even in the heater 12 of this embodiment, the conduction tended to be reduced. However, when the heater 12 of this embodiment was used in the fixing apparatus of the image forming apparatus, no rise in resistance along with the deterioration of the through holes 12*i*, 12*j*, 12*k*, 12*l*, 12*m*, and 12*n* was observed in the same number of times, and there was no problem for actual use.

Further, as compared to the heater 12 of Embodiment 5, the heater 12 of this embodiment achieved a longer life by 150 times in the number of testing times, and such an effect was confirmed that, by increasing the number of power feeding contacts, the reliability was increased. That is, although the number of power feeding contacts per one power feeding electrode portion in Embodiment 5 was 1 and the number of power feeding contacts in this embodiment was 2, it is easy to presume that, even in a configuration in which the number of power feeding contacts is further increased, the reliability of the electrification of the heater can be increased.

Further, in this embodiment, the number of through holes and the number of power feeding contacts per one power feeding electrode portion were set to 3 and 2, respectively. However, it is easy to presume that, even in a configuration in which the number of through holes is further increased, by providing multiple power feeding contacts per one power feeding electrode portion, the reliability of the electrification of the heater can be increased.

Further, in this embodiment, comparison was made between the case where the two power feeding contacts in the one power feeding electrode portion were all included in the area formed by the through holes and the case where none of the two power feeding contacts were included therein. However, as long as at least one of the two power feeding contacts is included in the area formed by the through holes, a configuration similar to that of Embodiment 1 is obtained, and thus similar effects can be obtained. Therefore, it is easy to presume that, in a configuration in which at least three through holes and at least three power feeding contacts are provided, by providing at least one power feeding contact within the area formed by the through holes, the reliability of the electrification of the heater can be increased.

Also in the heater 12 of this embodiment, even in a case where, similarly to Embodiment 6, the heat generating resistor 12*c* is formed only on one surface of the substrate 12*a*, that is, the heat generating resistor 12*b* and the power feeding electrode portion 12*g* are not provided, similar actions and effects can be obtained.

The heater 12 in this case includes the substrate 12*a*, the power feeding electrode portions 12*f* and 12*h*, the heat generating resistor 12*c*, the conductors 12*o* and 12*p*, and the through holes 12*i*, 12*j*, 12*k*, 12*l*, 12*m*, and 12*n*. Further, the power feeding contacts 16*b* and 16*g* are included in the area t1, and the power feeding contacts 16*f* and 16*i* are included in the area t2. With this, the burning of the through holes 12*i*, 12*j*, 12*k*, 12*l*, 12*m*, and 12*n* and the conduction failure caused by the burning can be prevented.

Also in the heater 12 of this embodiment, even in a case where, similarly to Embodiment 7, the positions of the power feeding electrode portions 12*f* and 12*h* are changed, similar actions and effects can be obtained. Also in this case, the power feeding contacts 16*b* and 16*g* are included in the area t1 and the power feeding contacts 16*f* and 16*i* are included in the area t2. With this configuration, the burning of the through holes 12*i*, 12*j*, 12*k*, 12*l*, 12*m*, and 12*n* and the conduction failure caused by the burning can be prevented.

(Other Embodiments)

The fixing apparatus according to Embodiments 1 to 9 is not limited for use as an apparatus for heating the unfixed toner image t borne by the recording material P to fix the toner image t onto the recording material. The fixing apparatus may also be used for, for embodiment, an image heating apparatus for heating the unfixed toner image to temporarily fix the toner image onto the recording material, or an image heating apparatus for heating a toner image that has been heated and fixed onto the recording material to give gloss to the toner image surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-240227, filed on Nov. 1, 2011, and No. 2012-108476, filed on May 10, 2012, which are hereby incorporated by reference herein in their entirety.

What is claimed is:

1. An image heating apparatus, comprising:

an endless belt;

a heater provided in contact with an inside surface of the endless belt; and a connector configured to supply power to the heater, wherein the heater comprises:

an insulated substrate;

a heat generating resistor provided on the insulated substrate;

an electrode electrically connected to the heat generating resistor and brought into contact with a contact of the connector; and a conductor electrically connected to the heat generating resistor and provided on a surface of the insulated substrate opposite to a surface on which the electrode is provided, wherein the insulated substrate comprises multiple through holes in an area in which one electrode is provided, the multiple through holes electrically connecting the electrode and the conductor to each other, and wherein the through holes are spaced from a contact position on the electrode brought into contact with the contact, wherein distances between one contact position on the electrode brought into contact with the contact and the multiple through holes are substantially equal to each other, the contact position and the multiple through holes are electrically connected to each other, and a current flowing from the contact of the connector is divided at the contact position and each of the divided currents flows to a different one of the through holes.

2. An image heating apparatus according to claim 1, wherein the heat generating resistor comprises:

a first heat generating resistor provided on one surface of the insulated substrate; and second heat generating resistor provided on another surface of the insulated substrate, wherein the electrode comprises:

a first electrode connected to one end portion of the first heat generating resistor;

a third electrode electrically connected to another end portion of the first heat generating resistor; and a second electrode which avoids being electrically connected to the first heat generating resistor and is provided closer to the third electrode than the first electrode, the first electrode, the second electrode, and the third electrode being provided on the one surface of the insulated substrate, and wherein the conductor comprises:

a first conductor connected to the first electrode via the multiple through holes and connected to one end portion of the second heat generating resistor; and a second conductor connected to the second electrode via the multiple through holes and connected to another end portion of the second heat generating resistor, wherein the first conductor and the second conductor are provided on another surface of the insulated substrate.

3. An image heating apparatus according to claim 2, wherein the first heat generating resistor and the second heat generating resistor have different lengths in a longitudinal direction of the insulated substrate.

4. An image heating apparatus according to claim 1, wherein distances between one end portion of the heat generating resistor and the multiple through holes are substantially equal to each other.

5. An image heating apparatus according to claim 1, wherein the multiple through holes comprise at least three through holes with respect to one electrode.

6. A heater to be used in an image heating apparatus, the heater comprising:

an insulated substrate;

a heat generating resistor provided on the insulated substrate;

an electrode electrically connected to the heat generating resistor and brought into contact with a contact of a connector, the connector being provided to supply power to the image heating apparatus; and a conductor electrically connected to the heat generating resistor and provided on a surface of the insulated substrate opposite to a surface on which the electrode is provided, wherein the insulated substrate comprises multiple through holes in an area in which one electrode is provided, the multiple through holes electrically connecting the electrode and the conductor to each other, and wherein the through holes are spaced from a contact position on the electrode brought into contact with the contact, wherein distances between one contact position on the electrode brought into contact with the contact and the multiple through holes are substantially equal to each other, the contact position and the multiple through holes are electrically connect to each other, and a current flowing from the contact of the connector is divided at the contact position and each of the divided currents flows to a different one of the through holes.

7. A heater according to claim 6, wherein the heat generating resistor comprises:

a first heat generating resistor provided on one surface of the insulated substrate; and a second heat generating resistor provided on another surface of the insulated substrate, wherein the electrode comprises:

a first electrode connected to one end portion of the first heat generating resistor;

a third electrode connected to another end portion of the first heat generating resistor; and a second electrode which avoids being connected to the first heat generating resistor and is provided closer to the third electrode than the first electrode, the first electrode, the second electrode, and the third electrode being provided on the one surface of the insulated substrate, and wherein the conductor comprises:

a first conductor connected to the first electrode via the multiple through holes and connected to one end portion of the second heat generating resistor; and a second conductor connected to the second electrode via the multiple through holes and connected to another end portion of the second heat generating resistor, wherein the first conductor and the second conductor are provided on another surface of the insulated substrate.

8. A heater according to claim 7, wherein the first heat generating resistor and the second heat generating resistor have different lengths in a longitudinal direction of the insulated substrate.

9. A heater according to claim 6, wherein distances between one end portion of the heat generating resistor and the multiple through holes are substantially equal to each other.

10. A heater according to claim 6, wherein the multiple through holes comprise at least three through holes with respect to one electrode.

11. An image heating apparatus, comprising:

an endless belt;

a heater provided in contact with an inside surface of the endless belt; and a connector configured to supply power to the heater, wherein the heater comprises:

an insulated substrate;

a heat generating resistor provided on the insulated substrate;

an electrode electrically connected to the heat generating resistor and brought into contact with a contact of the connector; and a conductor electrically connected to the heat generating resistor and provided on a surface of the insulated substrate opposite to a surface on which the electrode is provided, wherein the insulated substrate comprises at least three through holes in an area in which one electrode is provided, the at least three through holes electrically connecting the electrode and the conductor to each other, and wherein a contact position on the electrode brought into contact with the contact is surrounded by the at least three through holes, and wherein the through holes are spaced from the contact position, the contact position and the through holes are electrically connected to each other, and a current flowing from the contact of the connector is divided at the contact position and each of the divided currents flows to a different one of the through holes.

12. An image heating apparatus according to claim 11, wherein the heat generating resistor comprises:

a first heat generating resistor provided on one surface of the insulated substrate; and a second heat generating resistor provided on another surface of the insulated substrate, wherein the electrode comprises:

a first electrode connected to one end portion of the first heat generating resistor;

a third electrode connected to another end portion of the first heat generating resistor; and a second electrode which avoids being connected to the first heat generating resistor and is provided closer to the third electrode than the first electrode, wherein the first electrode, the second electrode, and the third electrode are provided on the one surface of the insulated substrate, and wherein the conductor comprises:

a first conductor connected to the first electrode via the at least three through holes and connected to one end portion of the second heat generating resistor; and a second conductor connected to the second electrode via the at least three through holes and connected to another end portion of the second heat generating resistor, wherein the first conductor and the second conductor are provided on another surface of the insulated substrate.

13. An image heating apparatus according to claim 12, wherein the first heat generating resistor and the second heat generating resistor have different lengths in a longitudinal direction of the insulated substrate.

14. A heater for an image heating apparatus, wherein the heater comprises:

an insulated substrate;

a heat generating resistor provided on the insulated substrate;

an electrode electrically connected to the heat generating resistor and brought into contact with a contact of a connector, the connector being provided to supply power to the image heating apparatus; and a conductor electrically connected to the heat generating resistor and provided on a surface of the insulated substrate opposite to a surface on which the electrode is provided, wherein the insulated substrate comprises at least three through holes in an area in which one electrode is provided, the at least three through holes electrically connecting the electrode and the conductor to each other, and wherein a contact position on the electrode brought into contact with the contact is surrounded by the at least three through holes, and wherein the through holes are spaced from the contact position, the contact position and the through holes are electrically connected to each other, and a current flowing from the contact of the connector is divided at the contact position and each of the divided currents flows to a different one of the through holes.

15. A heater according to claim 14, wherein the heat generating resistor comprises:

a first heat generating resistor provided on one surface of the insulated substrate; and a second heat generating resistor provided on another surface of the insulated substrate, wherein the electrode comprises:

a first electrode connected to one end portion of the first heat generating resistor;

a third electrode connected to another end portion of the first heat generating resistor; and a second electrode which avoids being connected to the first heat generating resistor and is provided closer to the third electrode than the first electrode, wherein the first electrode, the second electrode, and the third electrode are provided on the one surface of the insulated substrate, and wherein the conductor comprises:

a first conductor connected to the first electrode via the at least three through holes and connected to one end portion of the second heat generating resistor; and a second conductor connected to the second electrode via the at least three through holes and connected to another end portion of the second heat generating resistor, wherein the first conductor and the second conductor are provided on another surface of the insulated substrate.

16. A heater according to claim 15, wherein the first heat generating resistor and the second heat generating resistor have different lengths in a longitudinal direction of the insulated substrate.

* * * * *